US012415248B2

(12) United States Patent
Park et al.

(10) Patent No.: US 12,415,248 B2
(45) Date of Patent: Sep. 16, 2025

(54) SUBSTRATE POLISHING APPARATUS, SUBSTRATE POLISHING METHOD USING THE SAME, AND SEMICONDUCTOR FABRICATION METHOD INCLUDING THE SAME

(71) Applicant: Samsung Electronics Co., Ltd., Suwon-si (KR)

(72) Inventors: Hyojin Park, Hwaseong-si (KR); Songyun Kang, Suwon-si (KR); Sung Yong Park, Suwon-si (KR); Keon-Woo Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 674 days.

(21) Appl. No.: 17/696,277

(22) Filed: Mar. 16, 2022

(65) Prior Publication Data

US 2023/0052061 A1 Feb. 16, 2023

(30) Foreign Application Priority Data

Aug. 12, 2021 (KR) ..... 10-2021-0106621

(51) Int. Cl.
*B24B 49/18* (2006.01)
*B24B 37/04* (2012.01)
(Continued)

(52) U.S. Cl.
CPC ..... *B24B 49/183* (2013.01); *B24B 37/042* (2013.01); *B24B 37/30* (2013.01); *B24B 53/017* (2013.01)

(58) Field of Classification Search
CPC ..... B24B 49/183; B24B 37/042; B24B 37/30; B24B 53/017
See application file for complete search history.

(56) References Cited

U.S. PATENT DOCUMENTS 6,168,508 B1 1/2001 Nagahara et al.
6,254,456 B1 7/2001 Kirchner et al.
(Continued)

FOREIGN PATENT DOCUMENTS

KR 10-2003-0056341 A 7/2003
KR 100416808 B1 1/2004
(Continued)

*Primary Examiner* — Zandra V Smith
*Assistant Examiner* — Andre C Stevenson
(74) *Attorney, Agent, or Firm* — Harness, Dickey & Pierce, P.L.C.

(57) ABSTRACT

Disclosed is a substrate polishing method comprising placing a substrate into a substrate polishing apparatus, rotating each of the substrate and a polishing pad of the substrate polishing apparatus, allowing a bottom surface of the substrate to contact a top surface of the polishing pad, and determining whether the polishing pad would benefit from maintenance. The polishing pad includes a plurality of annular regions that are homocentric with a central point of the top surface of the polishing pad. The step of determining whether the polishing pad would benefit from maintenance includes ascertaining a state of the bottom surface of the substrate, and selecting one of the plurality of annular regions by using information about the state of the bottom surface of the substrate. The one of the plurality of annular regions would benefit from maintenance.

18 Claims, 27 Drawing Sheets

(51) Int. Cl.
*B24B 37/30* (2012.01)
*B24B 53/017* (2012.01)

(56) References Cited

U.S. PATENT DOCUMENTS

| | | | | |
|---|---|---|---|---|
| 6,309,282 | B1 | 10/2001 | Wright et al. | |
| 6,773,338 | B2 | 8/2004 | Yun et al. | |
| 10,828,747 | B2 | 11/2020 | Hiroo et al. | |
| 2006/0252349 | A1 | 11/2006 | Yoo et al. | |
| 2020/0101579 | A1* | 4/2020 | Suzuki | H01L 22/26 |
| 2020/0198092 | A1 | 6/2020 | Kim | |
| 2021/0053184 | A1* | 2/2021 | Chen | B24B 53/017 |
| 2021/0370466 | A1* | 12/2021 | Kung | B24B 53/017 |
| 2022/0410338 | A1* | 12/2022 | Yagi | B24B 37/26 |

FOREIGN PATENT DOCUMENTS

| | | | |
|---|---|---|---|
| KR | 100505448 | B1 | 8/2005 |
| KR | 100516657 | B1 | 9/2005 |
| KR | 2007-0018324 | A | 2/2007 |
| KR | 100761847 | B1 | 9/2007 |
| KR | 2012-0026460 | A | 3/2012 |

* cited by examiner

SUBSTRATE POLISHING APPARATUS, SUBSTRATE POLISHING METHOD USING THE SAME, AND SEMICONDUCTOR FABRICATION METHOD INCLUDING THE SAME

CROSS-REFERENCE TO RELATED APPLICATION

This U.S. nonprovisional application claims priority under 35 U.S.C § 119 to Korean Patent Application No. 10-2021-0106621 filed on Aug. 12, 2021 in the Korean Intellectual Property Office, the disclosure of which is hereby incorporated by reference in its entirety.

BACKGROUND

Inventive concepts relate to a substrate polishing apparatus, a substrate polishing method using the same, and/or a semiconductor fabrication method including the same, and more particularly, to a substrate polishing apparatus capable of controlling polishing for each region, a substrate polishing method using the substrate polishing apparatus, and/or a semiconductor fabrication method including the substrate polishing method.

Various processes may be performed to fabricate a semiconductor device. For example, the semiconductor device may be fabricated by performing a photolithography process, an etching process, and a deposition process on a substrate such as a wafer. It may be required or desired that a surface of the wafer be planarized prior to various processes. A polishing process may be executed on the wafer for planarization. The polishing process may be fulfilled in a variety of ways. For example, a chemical mechanical planarization/chemical mechanical polishing (CMP) process may be adopted to planarize the wafer.

SUMMARY

Some example embodiments of inventive concepts provide a substrate polishing apparatus capable of controlling polishing for each region, a substrate polishing method using the same, and/or a semiconductor fabrication method including the same.

Some example embodiments of inventive concepts provide a substrate polishing apparatus capable of controlling and managing a polishing pad for each region, a substrate polishing method using the same, and/or a semiconductor fabrication method including the same.

Alternatively or additionally, some example embodiments of inventive concepts provide a substrate polishing apparatus capable of reducing failure rate of a substrate edge region, a substrate polishing method using the same, and/or a semiconductor fabrication method including the same.

Alternatively or additionally, some example embodiments of inventive concepts provide a substrate polishing apparatus capable of increasing a manufacturing yield, a substrate polishing method using the same, and/or a semiconductor fabrication method including the same.

Objects of inventive concepts are not limited to the mentioned above, and other objects which have not been mentioned above will be clearly understood to those of ordinary skill in the art from the following description.

According to some example embodiments of inventive concepts, a substrate polishing method may comprise: placing a substrate into a substrate polishing apparatus; rotating each of the substrate and a polishing pad of the substrate polishing apparatus; allowing a bottom surface of the substrate to contact a top surface of the polishing pad; and determining whether the polishing pad may benefit from undergoing maintenance. The polishing pad may include a plurality of annular regions that are homocentric with a central point of the top surface of the polishing pad. The step of determining whether the polishing pad benefits from undergoing maintenance may include: ascertaining a state of the bottom surface of the substrate; and selecting one of the plurality of annular regions by using information about the state of the bottom surface of the substrate, the one of the plurality of annular regions benefiting from undergoing maintenance.

According to some example embodiments of inventive concepts, a semiconductor fabrication method may comprise: preparing a substrate; placing the substrate into a substrate polishing apparatus; rotating each of the substrate and a polishing pad of the substrate polishing apparatus; and allowing a bottom surface of the substrate to contact a top surface of the polishing pad. The step of having or allowing the bottom surface of the substrate to contact the top surface of the polishing pad may include allowing that that, in a polishing location, the bottom surface of the substrate is polished while being in contact with the top surface of the polishing pad. The polishing pad may include: a disk-shaped central region that includes a central point of the top surface of the polishing pad; and a plurality of annular regions that surround the central region and are homocentric with the central point. Among the plurality of annular regions that overlap a portion of the polishing location when viewed in plan, a width in a radius direction of an outer overlapping section with an outer annular region overlapping the polishing location may be less than a width in a radius direction of each of other annular regions that overlap the polishing location, the outer annular region being an outermost one of the plurality of annular regions that overlap a portion of the polishing location.

According to some example embodiments of inventive concepts, a substrate polishing apparatus may comprise: a polishing pad; and a polishing head that allows a substrate and the polishing pad to contact each other in a polishing location. The polishing pad may include a plurality of pads. The plurality of pad may include: a disk-shaped central pad that includes a central point of a top surface of the polishing pad; and a plurality of annular pads that surround the central pad and are homocentric with the central point. Among the plurality of pads that overlap a portion of the polishing location when viewed in plan, a width in a radius direction of an inner overlapping section with an inner overlapping pad overlapping the polishing location may be less than a width in a radius direction of each of other pads that overlap the polishing location, the inner overlapping pad being an innermost one of the plurality of pads that overlap a portion of the polishing location.

Details of other example embodiments are included in the description and drawings.

DETAILED DESCRIPTION OF VARIOUS EXAMPLE EMBODIMENTS

Figure 1:
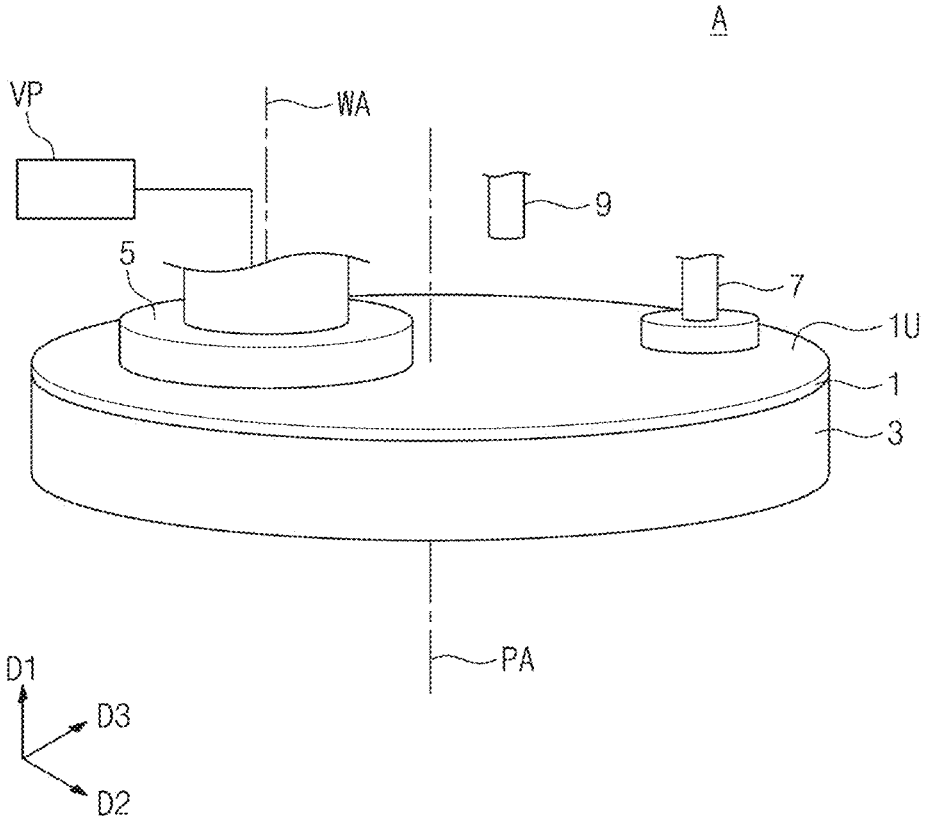
FIG. 1 illustrates a perspective view showing a substrate polishing apparatus according to some example embodiments of inventive concepts.

The following will now describe some example embodiments of inventive concepts with reference to the accompanying drawings. Like reference numerals may indicate like components throughout the description.

FIG. 1 illustrates a perspective view showing a substrate polishing apparatus according to some example embodiments of inventive concepts.

In this description below, symbols D1, D2, and D3 of FIG. 1 are respectively a first direction, a second direction that intersects the first direction D1 at an angle that may or may not be 90 degrees, and a third direction that intersects each of the first direction D1 and the second direction D2 at the same or different angles that may or may not be 90 degrees. The first direction D1 may be called an upward side, and a direction reverse to the first direction D1 may be called a downward side; however, example embodiments are not limited thereto. In addition, each of the second and third directions D2 and D3 may be called a horizontal direction.

Referring to FIG. 1, a substrate polishing apparatus A may be provided. The substrate polishing apparatus A may be or may include an apparatus for polishing a substrate. For example, the substrate polishing apparatus A may be an apparatus in which a chemical mechanical polishing (CMP) process is performed to polish and/or planarize one surface of the substrate. A semiconductor wafer, e.g. a wafer of 200 mm or 300 mm or 450 mm in diameter, may be adopted as the substrate that the substrate polishing apparatus A polishes. The semiconductor wafer may include a silicon (Si) wafer, but inventive concepts are not limited thereto.

The substrate polishing apparatus A may include a platen/stage 3, a polishing pad 1, a polishing head 5, a vacuum pump VP, a conditioning disk 7, and a slurry supply 9. Although not shown, the substrate polishing apparatus A may further include a robot such as a driver for rotational and parallel movements of each of the stage 3 and the polishing pad 1.

The stage 3 may support the polishing pad 1. The stage 3 may rotate the polishing pad 1. For example, the driver may drive the stage 3 to rotate the polishing pad 1. The driver may be or may include one or more of a robot or an actuator.

The polishing pad 1 may have a disk shape. The polishing pad 1 may be disposed on the stage 3. The polishing pad 1 may polish the substrate. The polishing pad 1 may rotate. For example, the polishing pad 1 may rotate around a pad rotation axis PA that is parallel to/extends in the first direction D1. When the polishing pad 1 rotates, a top surface 1U of the polishing pad 1 may contact and polish a bottom surface of the substrate. The polishing pad 1 may be divided into a plurality of regions. Each region of the polishing pad 1 may be called a pad. For example, the polishing pad 1 may include a plurality of pads. A detailed description thereof will be further discussed below.

The polishing head 5 may support the substrate. The polishing head 5 may move the substrate. The polishing head 5 may rotate. For example, in a state where the polishing head 5 is combined with or coupled with the substrate, the polishing head 5 may rotate around a substrate rotation axis WA that is parallel to/extends in the first direction D1 and is parallel to the pad rotation axis PA. In a state where the substrate is joined below the polishing head 5, the polishing head 5 may move upward from the polishing pad 1. The polishing head 5 may move downward toward the polishing pad 1 to allow the bottom surface of the substrate (e.g. the surface of the substrate to be planarized) to contact the top surface IU of the polishing pad 1. The polishing head 5 and the substrate may be combined in a variety of ways. For example, the polishing head 5 may use a vacuum adsorption method to adsorb the substrate. The polishing head 5 may be connected to the vacuum pump VP. Inventive concepts, however, are not limited thereto, and the polishing head 5 may be combined with the substrate by using various methods. A detailed description thereof will be further discussed below.

The vacuum pump VP may be connected to the polishing head 5. The vacuum pump VP may provide the polishing head 5 with vacuum pressure. The vacuum pressure provided from the vacuum pump VP may cause the polishing head 5 to adsorb the substrate.

The conditioning disk 7 may move on the polishing pad 1. The conditioning disk 7 may selectively contact the top surface 1U of the polishing pad 1. While the polishing pad 1 rotates, the conditioning disk 7 may contact the top surface 1U of the polishing pad 1. The conditioning disk 7 may change a state of the top surface 1U of the polishing pad 1. For example, the conditioning disk 7 may abrade the top surface 1U of the polishing pad 1. For example, the conditioning disk 7 may polish the polishing pad 1 which may improve a state of the polishing pad 1. During and/or after a polishing process on the substrate, the conditioning disk 7 may contact the polishing pad 1.

The slurry supply 9 may provide the polishing pad 1 with slurry. For example, the slurry supply 9 may supply the top surface 1U of the polishing pad 1 with the slurry to satisfactorily perform a polishing process on the substrate. The driver may rotate one or more of the stage 3 and the polishing head 5. Alternatively or additionally, the driver may drive the polishing head 5 to move parallel. The driver may include an actuator, such as a hydraulic motor and/or an electric motor.

Figure 2:
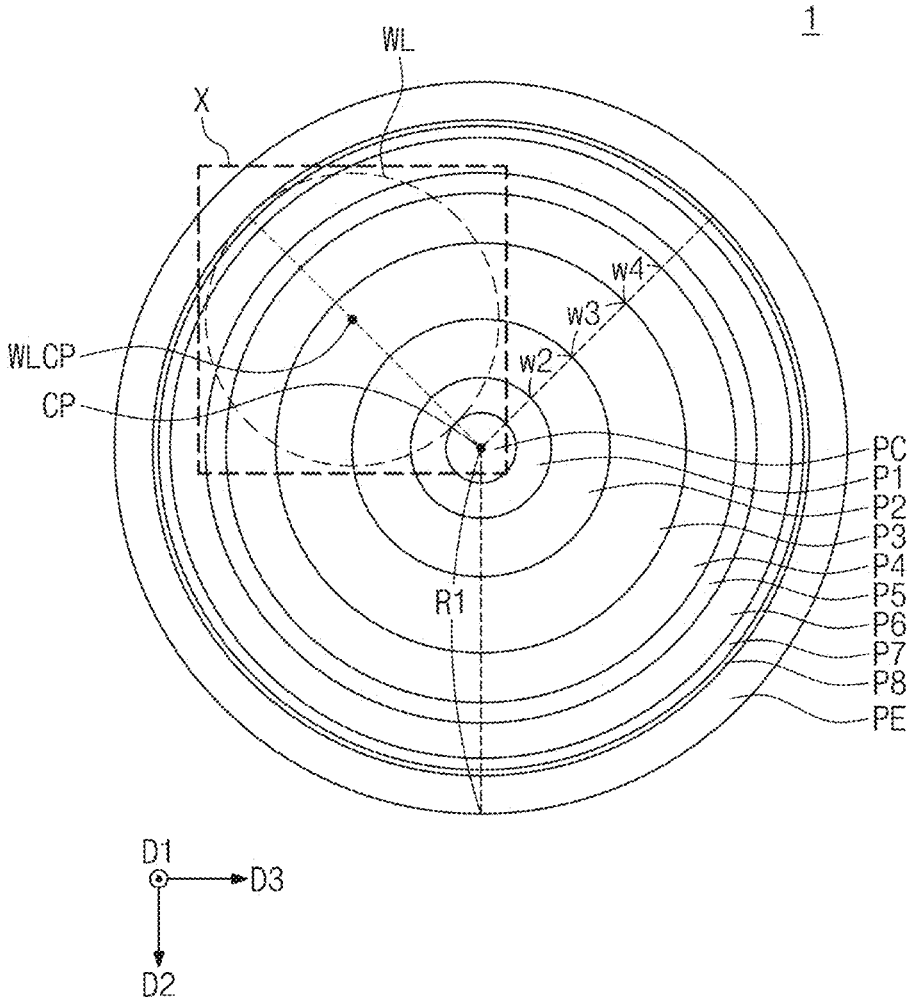
FIG. 2 illustrates a plan view showing a polishing pad of a substrate polishing apparatus according to some example embodiments of inventive concepts.
Figure 3:
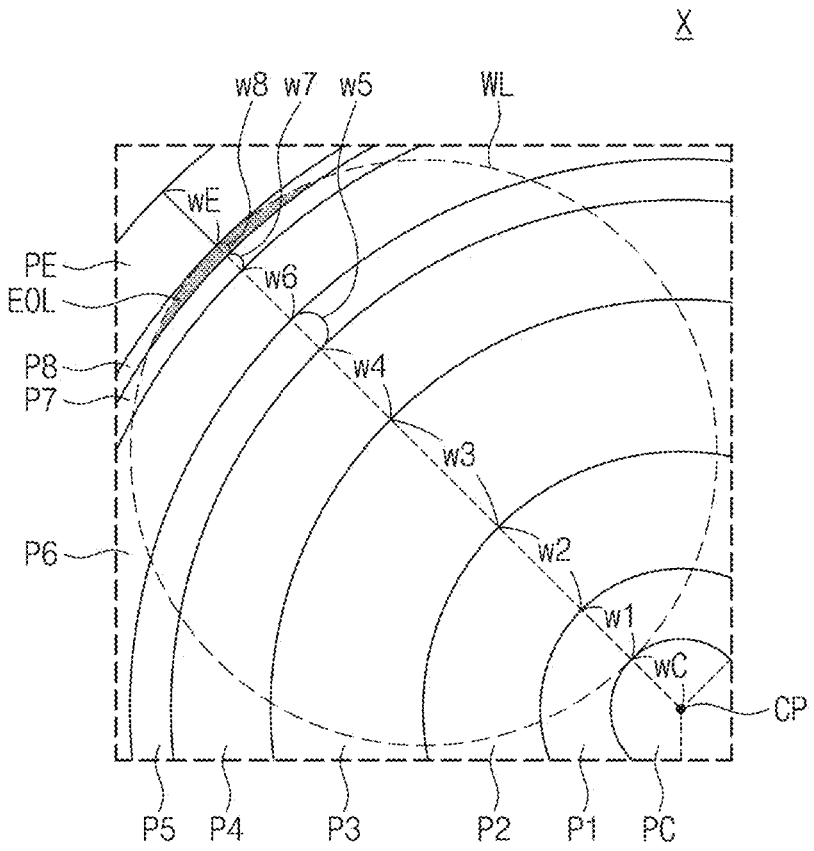
FIG. 3 illustrates an enlarged plan view showing section X of FIG. 2.

FIG. 2 illustrates a plan view showing a polishing pad of a substrate polishing apparatus according to some example embodiments of inventive concepts. FIG. 3 illustrates an enlarged plan view showing section X of FIG. 2.

Referring to FIGS. 2 and 3, the polishing pad 1 may have a circular shape with a central point CP when viewed in plan. A first radius R1 may be given as a radius at the top surface 1U of the polishing pad 1. The first radius R1 may range from about 650 mm to about 850 mm; however, example embodiments are not limited thereto, and the first radius R1 may be greater or less, and may be based on a diameter of the substrate. For example, the first radius R1 may be about 750 mm. As discussed above, the polishing pad 1 may be divided into a plurality of regions. For example, the polishing pad 1 may be divided into a central region PC and a plurality of annular regions P1 to P8 and PE.

The central region PC may be a section that includes the central point CP. The central region PC may have a disk shape. The central region PC may have a radius which is called a central radius wC (see FIG. 3). The central region PC may be called a central pad.

When viewed in plan, each of the plurality of annular regions P1 to P8 and PE may surround the central region PC. All of the plurality of annular regions P1 to P8 and PE may be homocentric. For example, the central point CP may be a center of each of the plurality of annular regions P1 to P8 and PE. The plurality of annular regions P1 to P8 and PE may have different diameters from each other. A first annular region P1 to an Nth annular region may be provided, and a boundary annular region PE may also be provided.

The first annular region P1 may contact/overlap the central region PC. The first annular region P1 may surround the central region PC. A first width w1 may be given as a width in a diameter direction of the first annular region P1. The first annular region P1 may be called a first annular pad.

An $X^{th}$ annular region may contact an $(X-1)^{th}$ annular region. The $X^{th}$ annular region may surround the $(X-1)^{th}$ annular region. An $X^{th}$ width may be given as a width in a diameter direction of the $X^{th}$ annular region. The $X^{th}$ annular region may be called an $X^{th}$ annular pad. The symbol X may be an arbitrary natural number equal to or greater than 2. The symbol X may be the same as or less than the symbol N.

The $N^{th}$ annular region may surround an $(N-1)^{th}$ annular region. An $N^{th}$ width may be given as a width in a diameter direction of the $N^{th}$ annular region. The $N^{th}$ annular region may be called an $N^{th}$ annular pad.

The symbol N may be 8. For example, the first to eighth annular regions P1 to P8 may be provided. Inventive concepts, however, are not limited thereto, and the symbol N may have a value other than (e.g. greater than or less than) 8.

The boundary annular region PE may surround the $N^{th}$ annular region. For example, when the symbol N is 8, the boundary annular region PE may surround the eighth annular region P8. A boundary width wE may be given as a width in a diameter direction of the boundary annular region PE. The boundary annular region PE may be a boundary annular pad.

In some example embodiments, the plurality of regions may be separated from each other. For example, the central region PC, the first to eighth annular regions P1 to P8, and the boundary annular region PE may be separated from each other, e.g. may be separable from each other and/or different physical pieces from each other. Inventive concepts, however, are not limited thereto, and the plurality of regions may be formed into a single unitary/single integrated piece. A detailed description thereof will be further discussed below with reference to FIG. 20. Various methods may be employed to fabricate/manufacture the polishing pad 1 including a plurality of regions that are separable from each other. For example, a three-dimensional printing may be used to manufacture the polishing pad 1. A three-dimensional printing may be used to also manufacture the polishing pad 1 including a plurality of regions that constitute a single unitary piece.

The plurality of regions may have different physical properties. For example, at least two among the plurality of regions may have different physical properties. The physical properties may include at least one selected from modulus of elasticity, hardness, roughness, density, porosity, and groove shape/groove profile/groove thickness. Neighboring ones among the plurality of regions may have different physical properties. Alternatively, all of the plurality of regions may have different physical properties.

A polishing location WL may be provided on the top surface 1U of the polishing pad 1. The polishing location WL may indicate a position where the bottom surface of the substrate (or surface of the substrate to be planarized/polished) is disposed. For example, the polishing pad 1 may have the polishing location WL at a portion where the bottom surface of the substrate is in contact with the top surface 1U of the polishing pad 1 during rotation thereof. Even when the polishing pad 1 rotates, the polishing location WL may be fixed at a specific position. When the substrate has a circular shape at the bottom surface thereof, the polishing location WL may also have a circular shape. For example, the polishing location WL may be a circle with a second central point WLCP as a center thereof. The substrate may have a radius of about 140 mm to about 160 mm. Therefore, the polishing location WL may have a radius of about 140 mm to about 160 mm. For example, the polishing location WL may have a radius of 150 mm or about 150 mm; however, example embodiments are not limited thereto. When viewed in plan, the polishing location WL may not overlap the central point CP. Inventive concepts, however, are not limited thereto, and when the polishing head (see 5 of FIG. 1) vibrates or moves during the polishing process, the polishing location WL may not have a circular shape. For example, the polishing location WL may have a shape that is changed within a range where the polishing location WL does not overlap the central point CP.

The polishing location WL may overlap at least portions of the plurality of pads. For example, when viewed in plan, at least portions of the central region PC and the plurality of annular regions P1 to P8 and PE may overlap the polishing location WL. For example, as shown in FIG. 3, a portion of each of the first to eighth annular regions P1 to P8 may overlap the polishing location WL. Neither the central region PC nor the boundary annular region PE may overlap the polishing location WL. An overlapping annular region may be defined to refer to an annular region at least a portion of which overlaps the polishing location WL. The overlapping annular region may be called an overlapping annular pad. In some example embodiments, e.g. in FIG. 3, each of the first to eighth annular regions P1 to P8 may be the overlapping annular region. An outer annular region may be defined to refer to an outermost one of the overlapping annular regions. For example, the outer annular region may indicate one of a plurality of overlapping annular regions that is most remote from the central point CP. In FIG. 3, the outer annular region may be the eighth annular region P8.

An outer overlapping section EOL may denote an area where the outer annular region overlaps the polishing location WL. In FIG. 3, the outer overlapping section EOL may mean or correspond to an area where the eighth annular region P8 and the polishing location WL overlap each other. A width in a radius direction of the outer overlapping section EOL may be less than those in a radius direction of other overlapping annular regions. In FIG. 3, the width of the outer overlapping section EOL may be the same as or similar to an eighth width w8 of the eighth annular region P8. Therefore, the eighth width w8 may be less than each of the first to seventh widths w1 to w7. For example, the eighth width w8 may be smaller than any other one of the first to eighth widths w1 to w8.

Figure 4A:
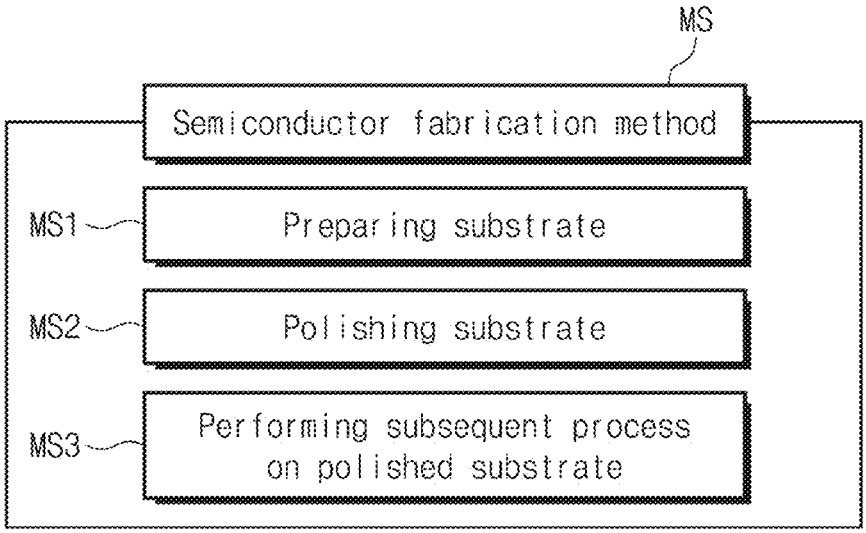
FIG. 4A illustrates a flow chart showing a semiconductor fabrication method according to some example embodiments of inventive concepts.

FIG. 4A illustrates a flow chart showing a semiconductor fabrication method according to some example embodiments of inventive concepts.

Referring to FIG. 4A, a semiconductor fabrication method MS may be provided. The semiconductor fabrication method MS may be or may include a semiconductor device fabrication method in which a substrate is used. The semiconductor fabrication method MS may include a step MS1 of preparing a substrate, a step MS2 of polishing the substrate, and a step MS3 of performing a subsequent process on the polished substrate.

The substrate preparation step MS1 may include preparing a substrate that has undergone one or more of semiconductor fabrication processes. For example, the substrate preparation step MS1 may include preparing a semiconductor wafer that has undergone one or more of a photolithography process, a deposition process, a prior substrate polishing process, or a development process, prior to a polishing process.

The substrate polishing step MS2 may mean or correspond to polishing and/or planarizing the prepared substrate. The substrate polishing step MS2 may be achieved by a substrate polishing method S of FIG. 4B. A detailed description thereof will be further discussed below.

The subsequent process execution step MS3 may include performing other semiconductor fabrication processes on the substrate released from the substrate polishing apparatus (see A of FIG. 1). For example, one or more of a photolithography process, a deposition process, an etching process, a subsequent substrate polishing process, or a packaging process may be performed on the substrate that has undergone the polishing process.

Figure 4B:
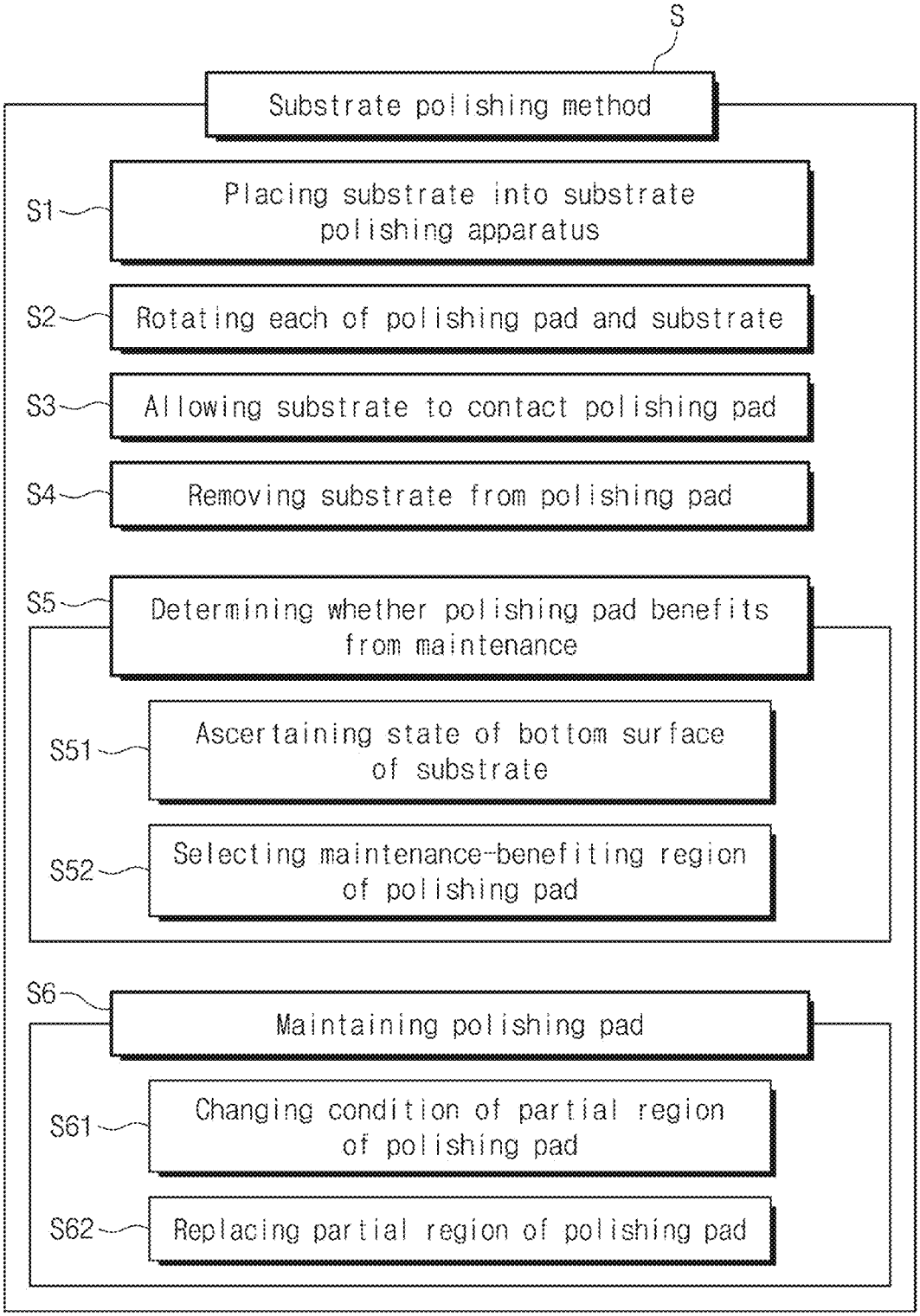
FIG. 4B illustrates a flow chart showing a substrate polishing method according to some example embodiments of inventive concepts.

FIG. 4B illustrates a flow chart showing a substrate polishing method according to some example embodiments of inventive concepts.

Referring to FIG. 4B, the substrate polishing method S may be provided. The substrate polishing method S may provide the substrate polishing step MS2 of the semiconductor fabrication method MS discussed with reference to FIG. 4A. For example, the substrate polishing method S may provide polishing and/or planarizing at least one surface of the substrate. The substrate polishing method S may include a step S1 of placing a substrate into a substrate polishing apparatus, a step S2 of rotating each of a polishing pad and the substrate, a step S3 of contacting the substrate with the polishing pad, a step S4 of removing the substrate from the polishing pad, a step S5 of determining whether the polishing pad requires or would benefit from maintenance, and a step S6 of maintaining the polishing pad.

The determination step S5 may include a step S51 of ascertaining a state of a bottom surface of the substrate, and a step S52 of selecting an area, which requires of or would benefit from maintenance, from the polishing pad.

The maintenance step S6 may include a step S61 of changing a condition of a partial area of the polishing pad, or a step S62 of replacing a partial area of the polishing pad.

With reference to FIGS. 5 to 19, the following description will focus on each step of the substrate polishing method S shown in FIG. 4B.

FIGS. 5 to 16 illustrate diagrams sequentially showing a substrate polishing procedure.

Figure 5:
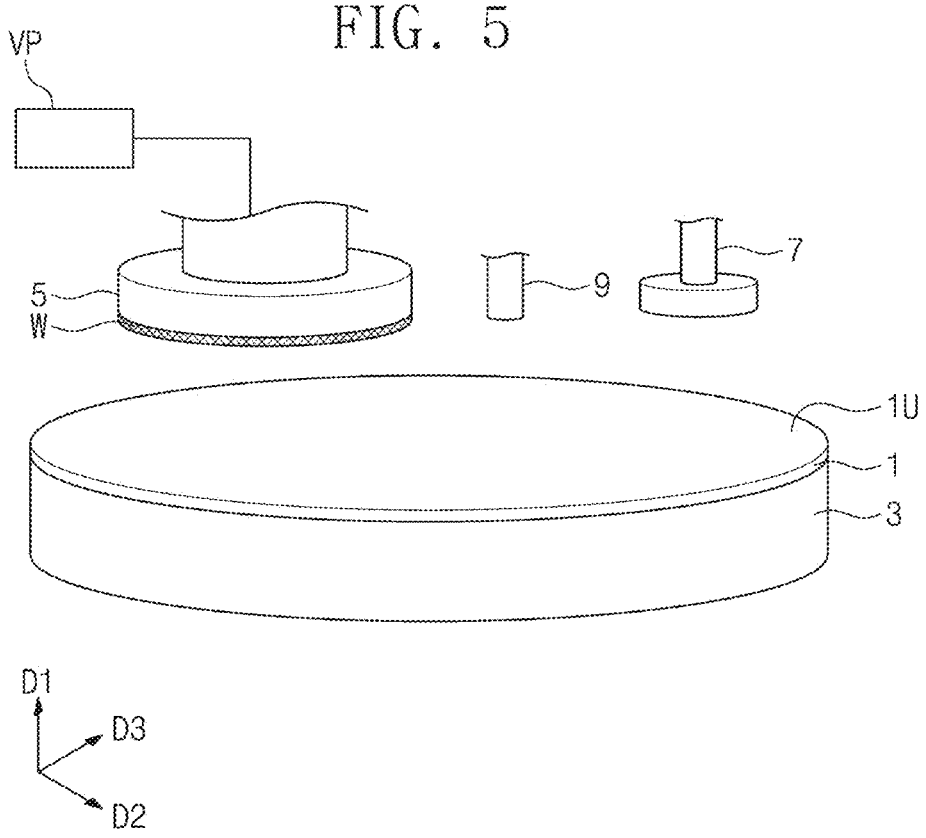
FIGS. 5 to 16 illustrate diagrams sequentially showing a substrate polishing procedure.
Figure 6:
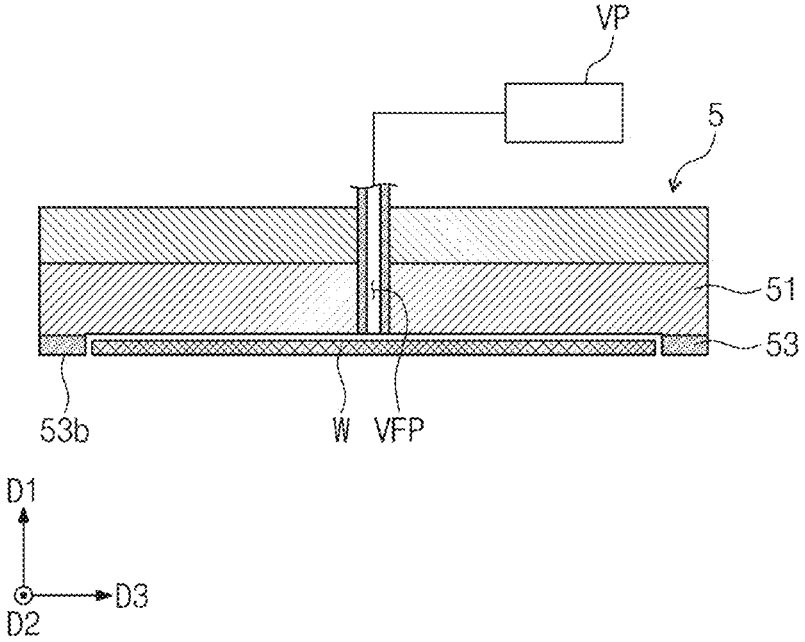

Referring to FIGS. 4B, 5, and 6, the substrate placement step S1 may include combining a substrate W with the polishing head 5.

Referring to FIG. 6, the polishing head 5 may include a head body 51 and a retaining ring 53. The head body 51 may provide a vacuum adsorption hole VFP. The vacuum adsorption hole VFP may be connected to the vacuum pump VP. A vacuum pressure may be transferred through the vacuum adsorption hole VFP from the vacuum pump VP, and the vacuum pressure may allow the head body 51 to vacuum-adsorb the substrate W on a back surface/un-patterned surface thereof. The retaining ring 53 may be coupled to the bottom surface of the head body 51. The retaining ring 53 may surround the substrate W adsorbed on the head body 51. The retaining ring 53 may have a bottom surface 53*b* in contact with the top surface 1U of the polishing pad 1.

Referring back to FIG. 5, the polishing pad 1 may be provided thereon with the polishing head 5 having the substrate W adsorbed thereon.

Figure 7:
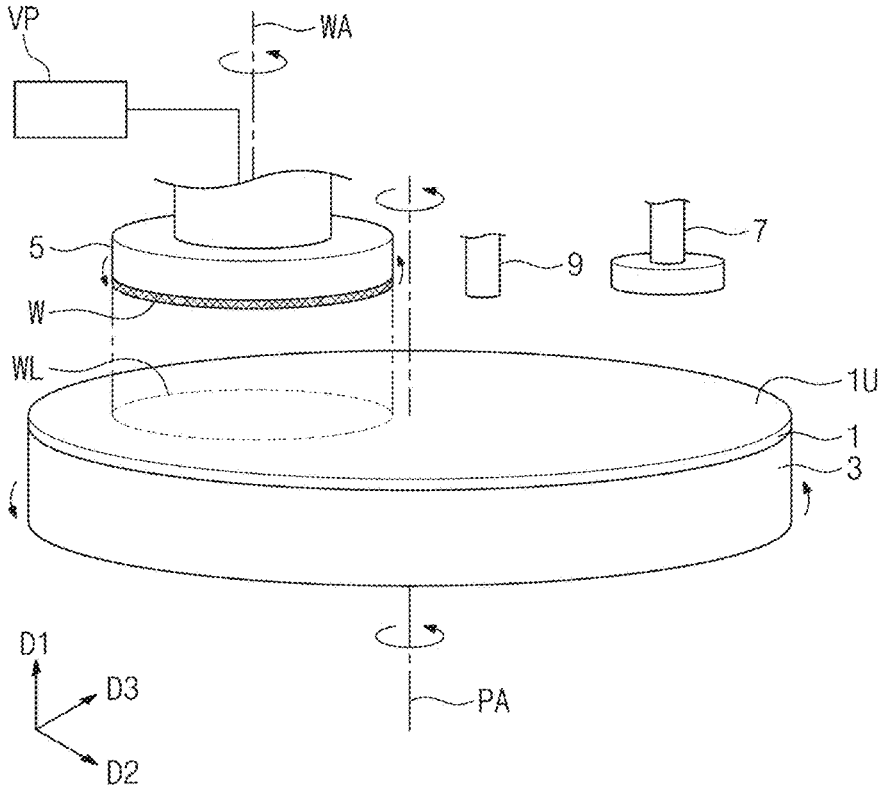
Figure 8:
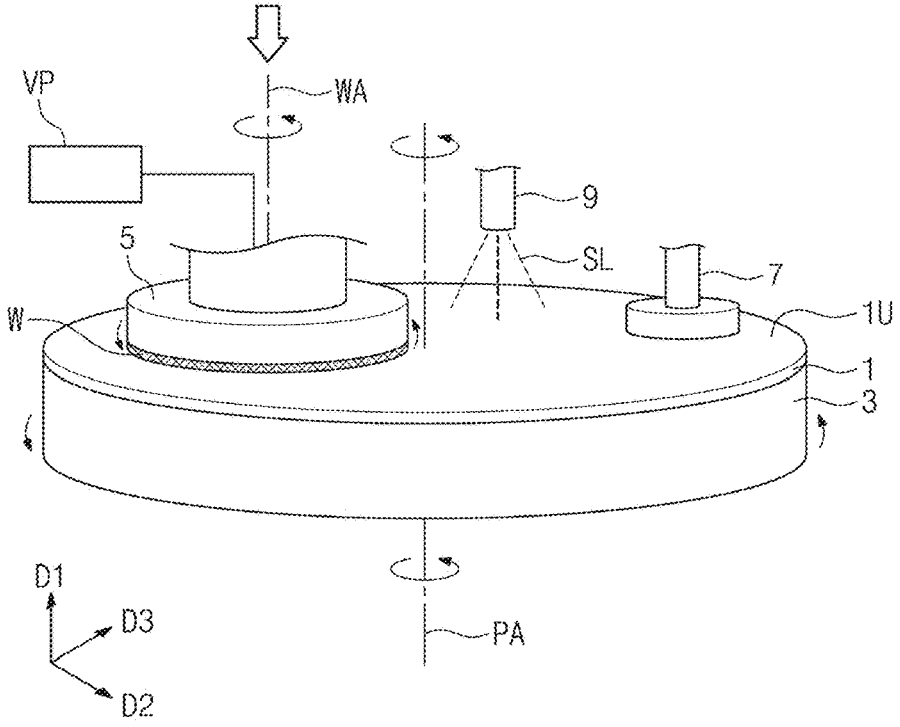

Referring to FIGS. 7 and 8, the rotation step S2 may include rotating the polishing pad 1 around the pad rotation axis PA and rotating the substrate W around the substrate rotation axis WA, e.g. simultaneously rotating the substrate W around the substrate rotation axis WA.

Referring to FIGS. 4B, 7, and 8, the contacting step S3 may include descending the polishing head 5 to allow a bottom surface of the substrate W (e.g. to contact the top surface 1U of the polishing pad 1. The substrate W may descend toward the polishing location WL. The bottom surface of the substrate W may contact the polishing pad 1 at the polishing location WL. For example, in the polishing location WL, the bottom surface of the substrate W during lotion thereof may contact the top surface 1U of the polishing pad 1 during location thereof. The bottom/patterned/front surface of/active surface of the substrate W to be polished may be polished on the top surface 1U of the polishing pad 1. The substrate W may only rotationally move and may be polished with the polishing pad 1. For example, during the polishing process, the polishing head 5 may only rotate the substrate W without parallel moving the substrate W. In this case, the polishing location WL may have a circular shape. Alternatively, during the polishing process, the substrate W may move not only rotationally but also parallel. For example, the polishing head 5 may vibrate in a horizontal direction within a specific area and may drive the substrate W to parallel move on the polishing pad 1. In this case, the polishing location WL may not be a full circle in shape.

In polishing procedure, the slurry supply 9 may supply slurry SL. The slurry SL may allow/enable favorable polishing between the top surface 1U of the polishing pad 1 and the bottom surface/active surface of the substrate W. Alternatively or additionally, the conditioning disk 7 may abrade the top surface 1U of the polishing pad 1.

Figure 9:
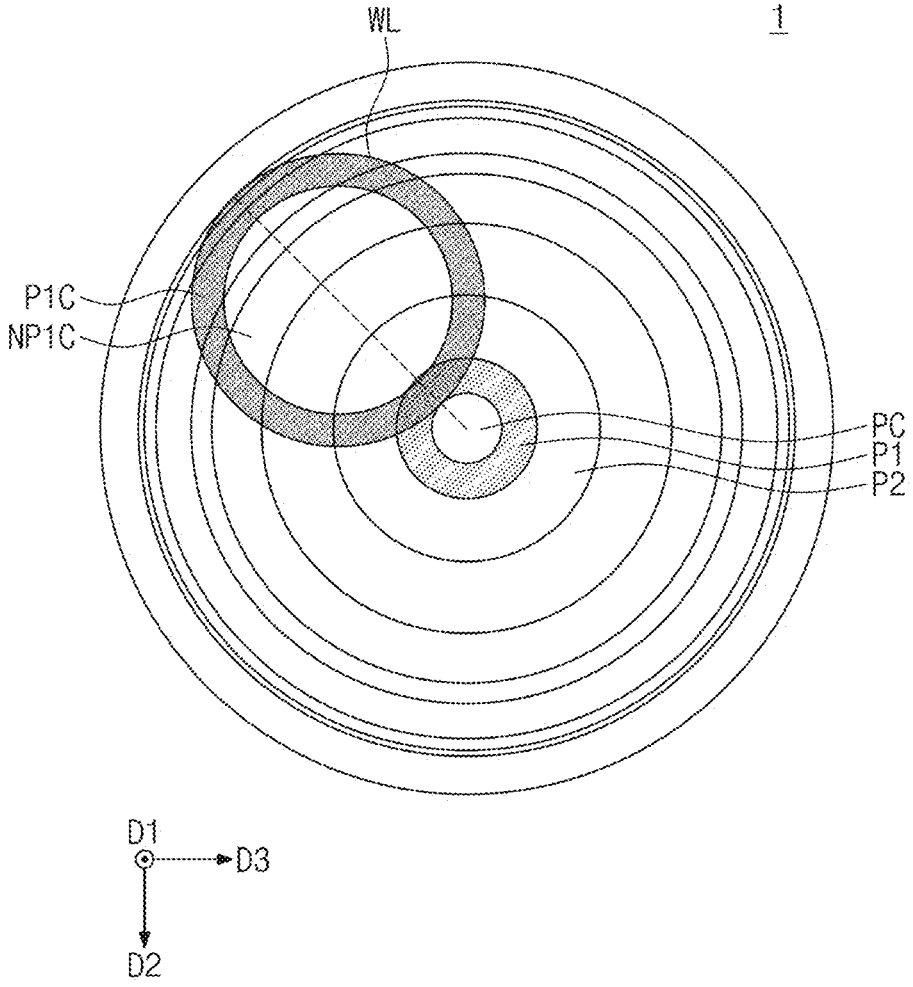

Referring to FIG. 9, the first annular region P1 of the polishing pad 1 that rotates during the polishing process may contact a portion of the substrate W that rotates in the polishing location WL. When the substrate W rotates in the polishing location WL, the bottom surface of/front surface of the substrate W may have a first polishing region P1C at a portion that is in contact with the first annular region P1. When the substrate W rotates in the polishing location WL, the bottom surface/front surface of the substrate W may have a first non-polishing region NP1C at a portion that is not in contact with the first annular region P1. The first polishing region P1C may be polished on the first annular region P1.

Figure 10:
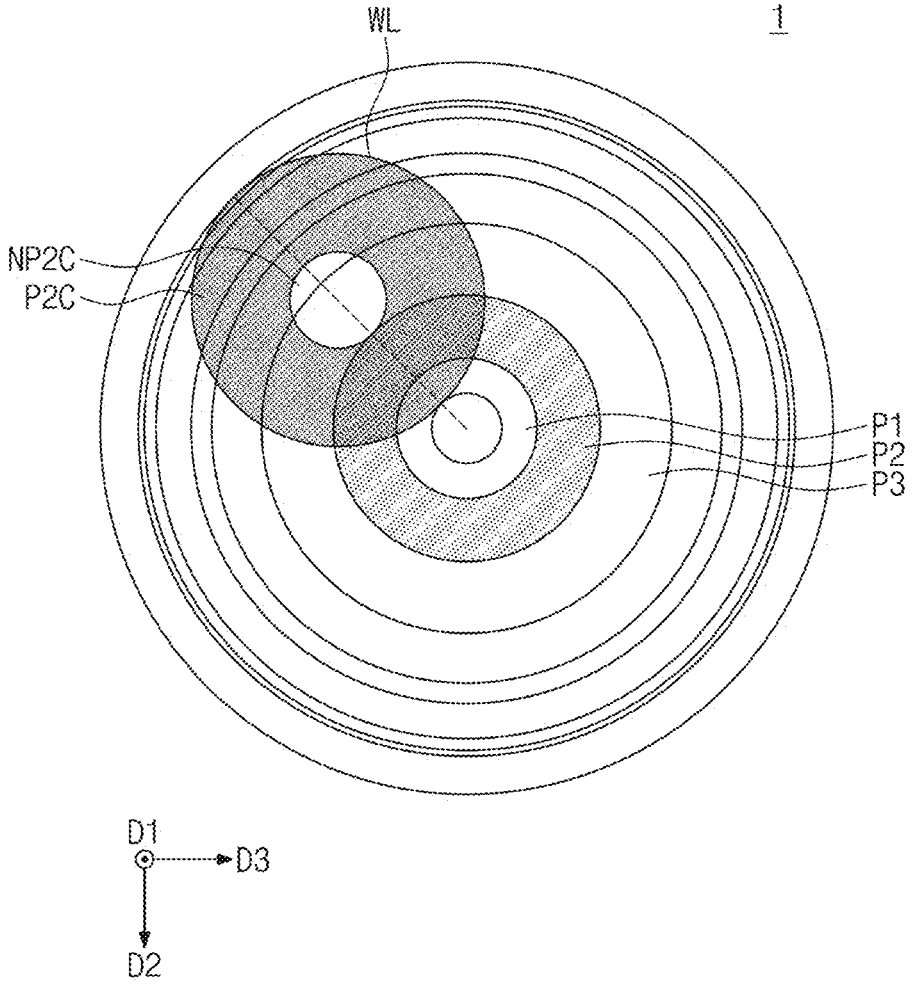

Referring to FIG. 10, the second annular region P2 of the polishing pad 1 that rotates during the polishing process may contact a portion of the substrate W that rotates in the polishing location WL. When the substrate W rotates in the polishing location WL, the bottom surface/front surface of the substrate W may have a second polishing region P2C at a portion that is in contact with the second annular region P2. When the substrate W rotates in the polishing location WL, the bottom surface/front surface of the substrate W may have a second non-polishing region NP2C at a portion that is not in contact with the second annular region P2. The second polishing region P2C may be polished on the second annular region P2.

Figure 11:
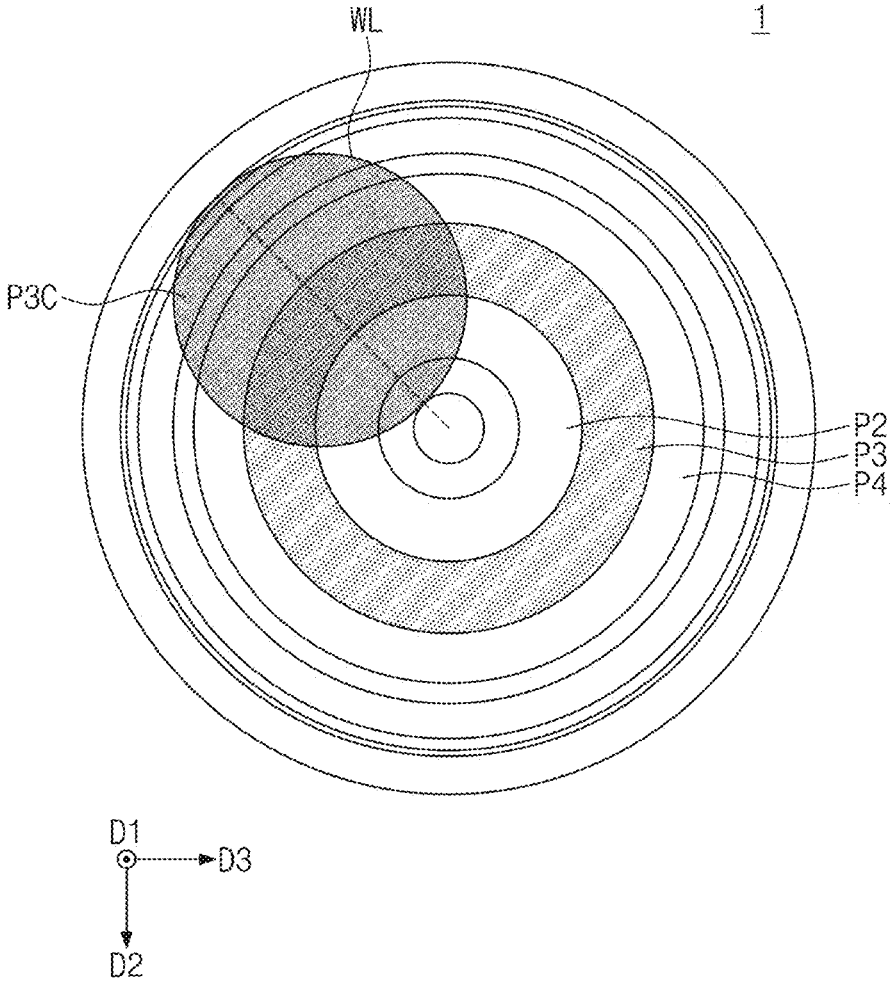

Referring to FIG. 11, the third annular region P3 of the polishing pad 1 that rotates during the polishing process may contact a portion of the substrate W that rotates in the polishing location WL. When the substrate W rotates in the polishing location WL, the bottom surface/front surface of the substrate W may have a third polishing region P3C at a portion that is in contact with the third annular region P3 (and other regions of the substrate W may not be in contact with the third annular region P3). When the substrate W rotates in the polishing location WL, the bottom surface of the substrate W may have a third non-polishing region NP3C at a portion that is not in contact with the third annular region P3. The third polishing region P3C may be polished on the third annular region P3.

Figure 12:
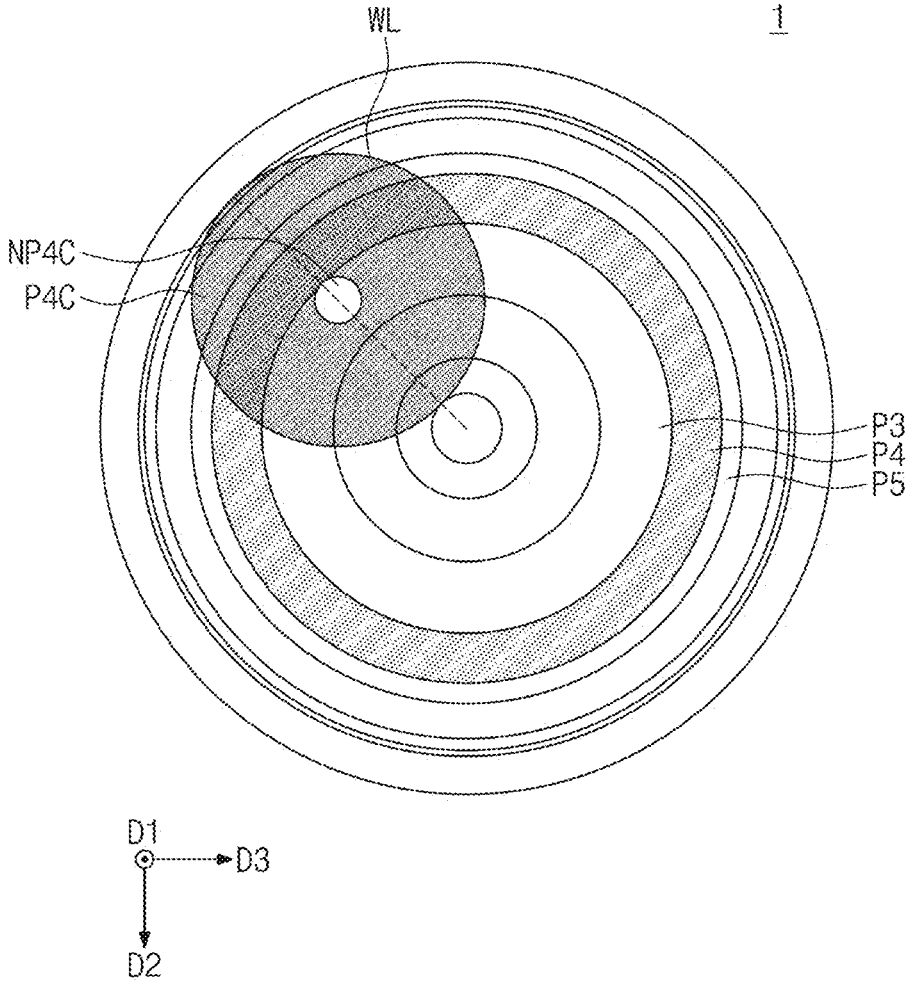

Referring to FIG. 12, the fourth annular region P4 of the polishing pad 1 that rotates during the polishing process may contact a portion of the substrate W that rotates in the polishing location WL. When the substrate W rotates in the polishing location WL, the bottom surface/front surface of the substrate W may have a fourth polishing region P4C at a portion that is in contact with the fourth annular region P4. When the substrate W rotates in the polishing location WL, the bottom surface/front surface of the substrate W may have a fourth non-polishing region NP4C at a portion that is not in contact with the fourth annular region P4. The fourth polishing region P4C may be polished on the fourth annular region P4.

Figure 13:
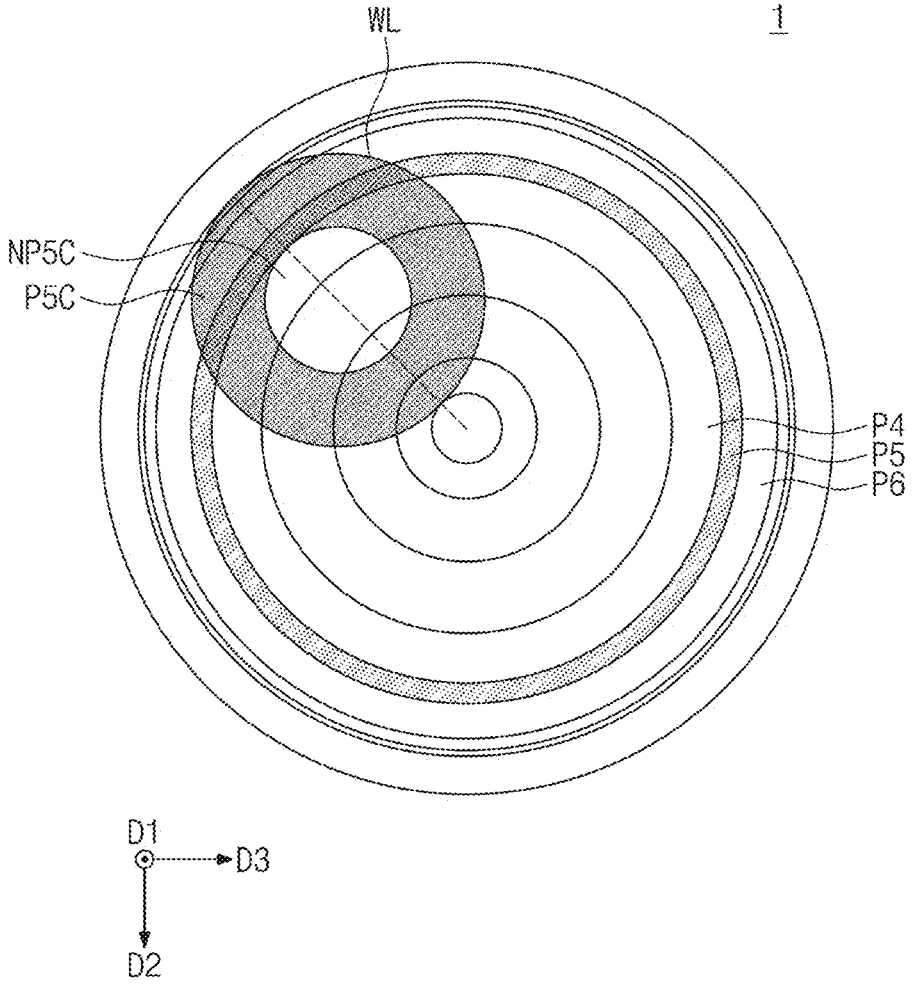

Referring to FIG. 13, the fifth annular region P5 of the polishing pad 1 that rotates during the polishing process may contact a portion of the substrate W that rotates in the polishing location WL. When the substrate W rotates in the polishing location WL, the bottom surface/front surface of the substrate W may have a fifth polishing region P5C at a portion that is in contact with the fifth annular region P5. When the substrate W rotates in the polishing location WL, the bottom surface of the substrate W may have a fifth non-polishing region NP5C at a portion that is not in contact with the fifth annular region P5. The fifth polishing region P5C may be polished on the fifth annular region P5.

Figure 14:
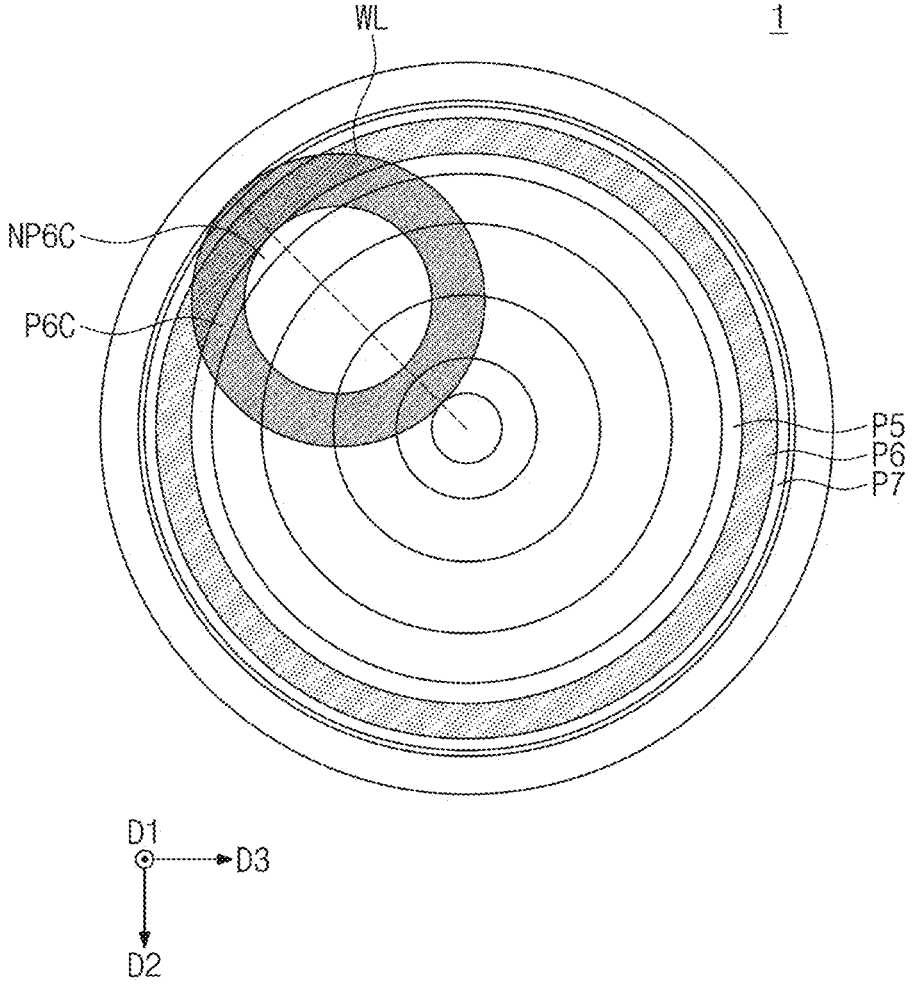

Referring to FIG. 14, the sixth annular region P6 of the polishing pad 1 that rotates during the polishing process may contact a portion of the substrate W that rotates in the polishing location WL. When the substrate W rotates in the polishing location WL, the bottom surface of the substrate W may have a sixth polishing region P6C at a portion that is in contact with the sixth annular region P6. When the substrate W rotates in the polishing location WL, the bottom surface/front surface of the substrate W may have a sixth non-polishing region NP6C at a portion that is not in contact with the sixth annular region P6. The sixth polishing region P6C may be polished on the sixth annular region P6.

Figure 15:
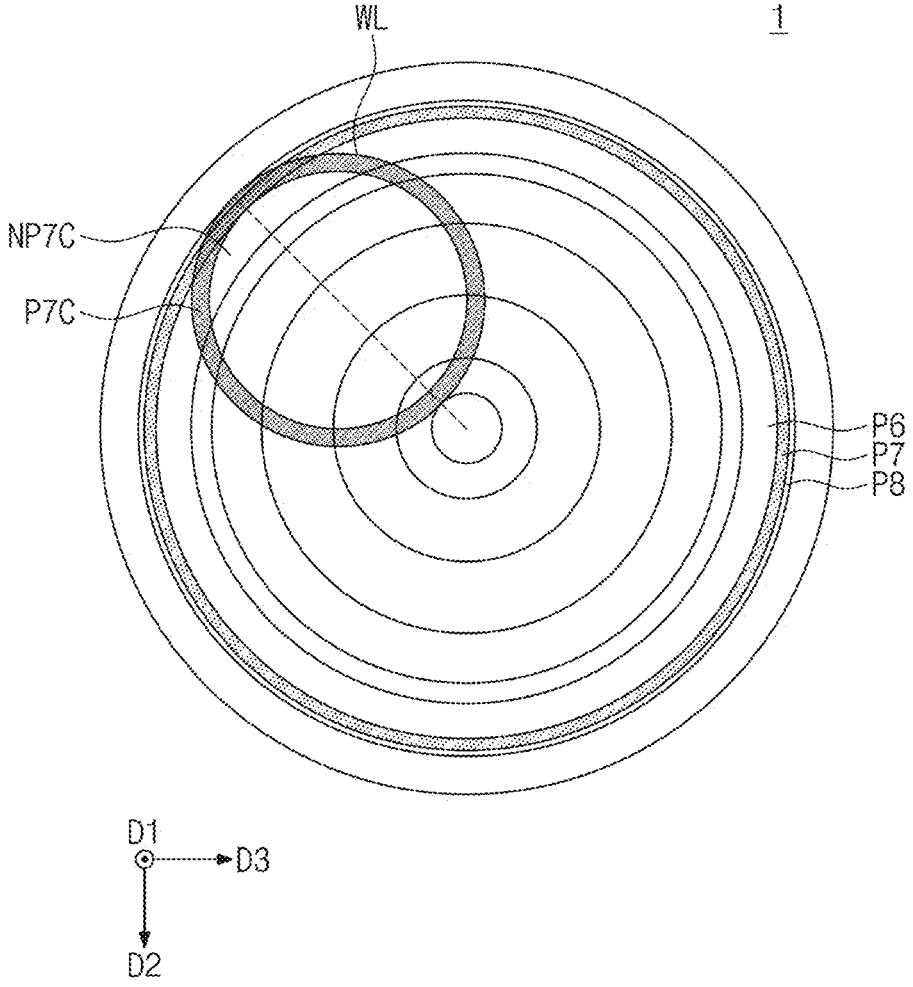

Referring to FIG. 15, the seventh annular region P7 of the polishing pad 1 that rotates during the polishing process may contact a portion of the substrate W that rotates in the polishing location WL. When the substrate W rotates in the polishing location WL, the bottom surface of the substrate W may have a seventh polishing region P7C at a portion that is in contact with the seventh annular region P7. When the substrate W rotates in the polishing location WL, the bottom surface of the substrate W may have a seventh non-polishing region NP7C at a portion that is not in contact with the seventh annular region P7. The seventh polishing region P7C may be polished on the seventh annular region P7.

Figure 16:
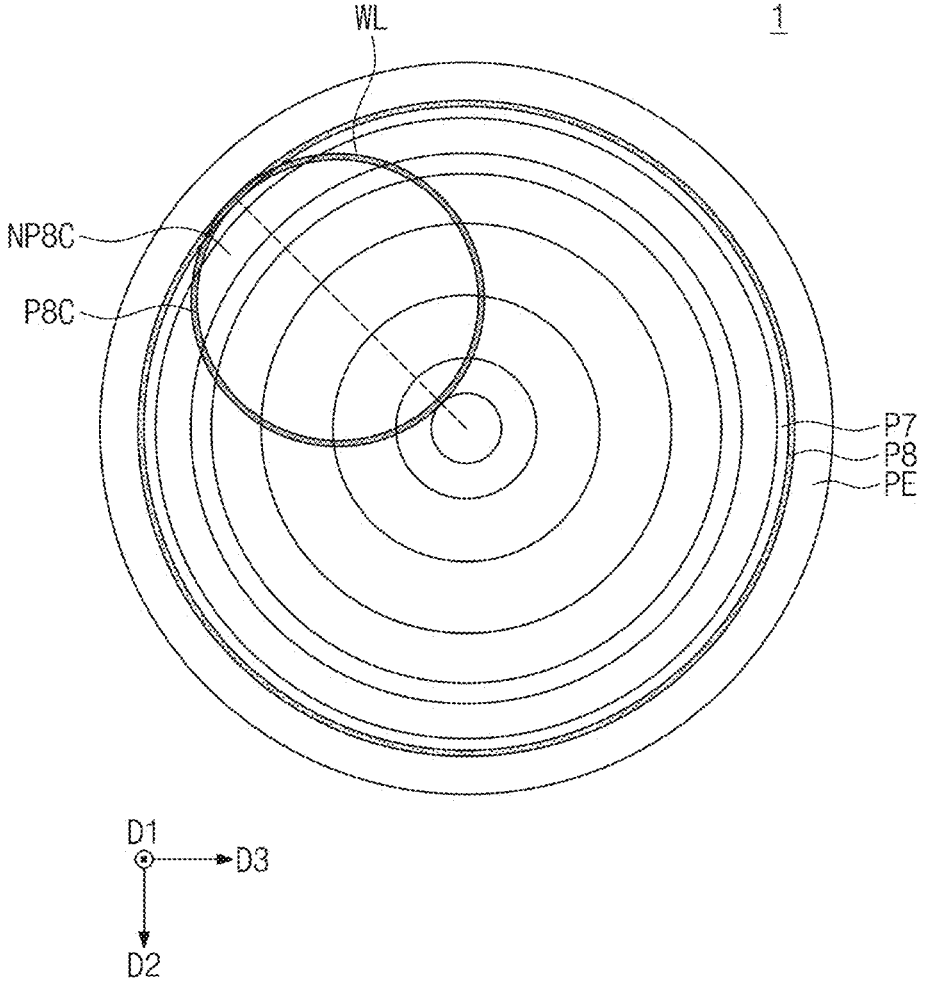

Referring to FIG. 16, the eighth annular region P8 of the polishing pad 1 that rotates during the polishing process may contact a portion of the substrate W that rotates in the polishing location WL. When the substrate W rotates in the polishing location WL, the bottom surface of the substrate W may have an eighth polishing region P8C at a portion that is in contact with the eighth annular region P8. When the substrate W rotates in the polishing location WL, the bottom surface of the substrate W may have an eighth non-polishing region NP8C at a portion that is not in contact with the eighth annular region P8. The eighth polishing region P8C may be polished on the eighth annular region P8.

Referring back to FIG. 4B, the substrate removal step S4 may including allowing the polished substrate W to drop from or be separated from the top surface IU of the polishing pad 1 (see FIG. 7). The substrate W may be removed from the substrate polishing apparatus (see A of FIG. 1). For example, the substrate W may be unloaded from the substrate polishing apparatus A.

Figure 17:
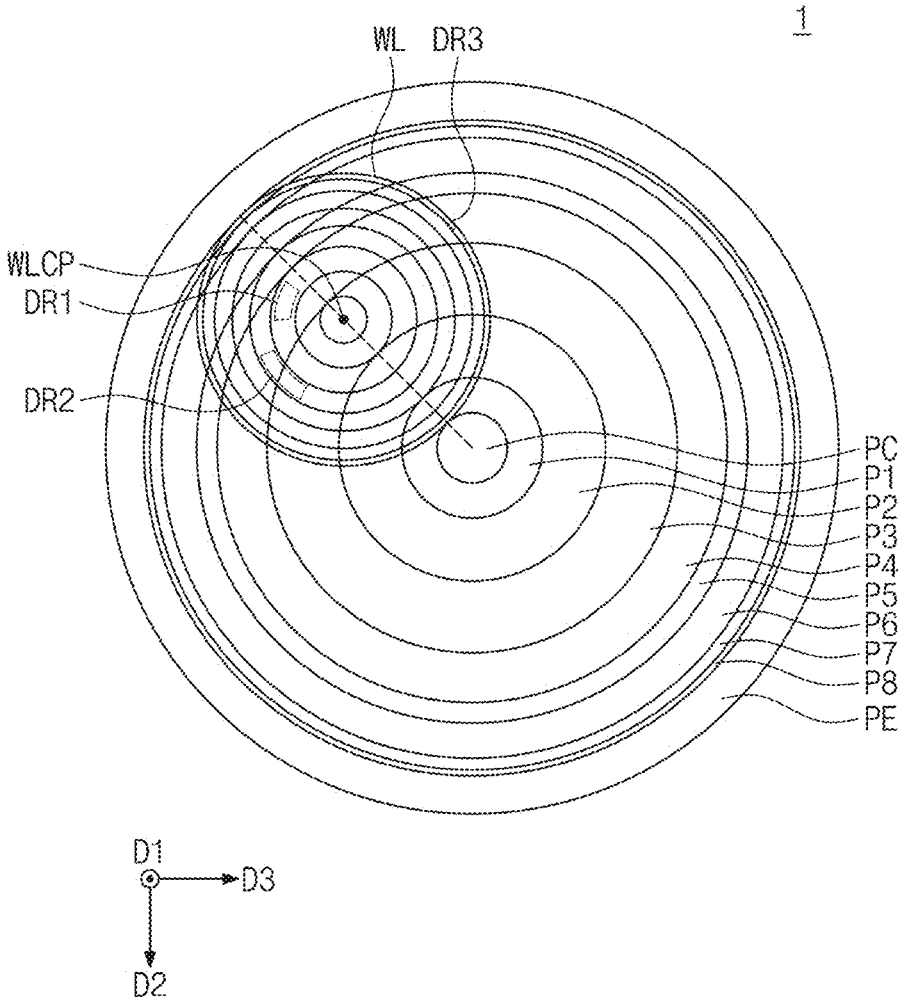
FIG. 17 illustrates a plan view showing a polishing pad on which a polished substrate is projected on a polishing location.
Figure 18:
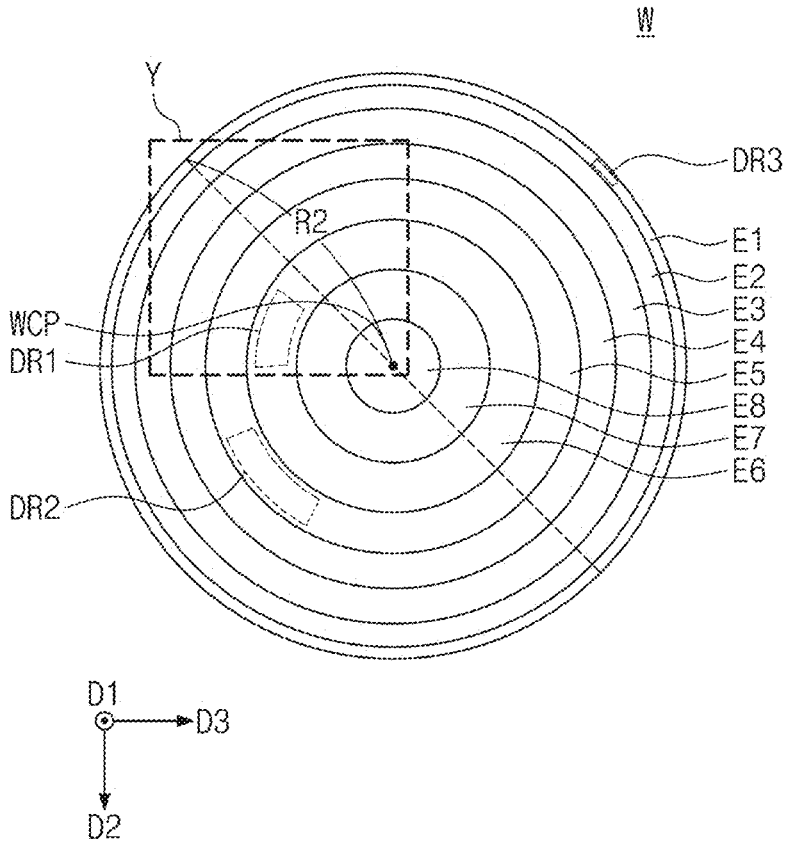
FIG. 18 illustrates a plan view showing a polished substrate.
Figure 19:
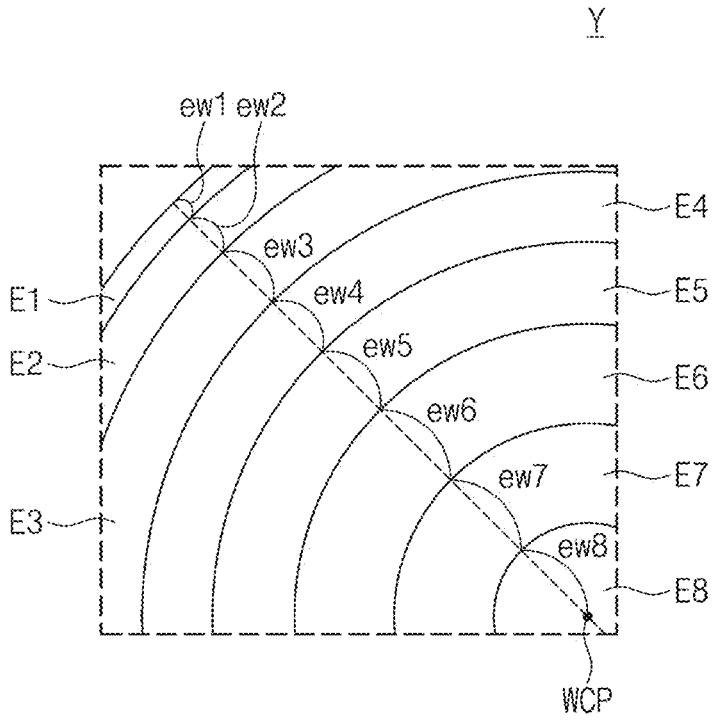
FIG. 19 illustrates an enlarged plan view showing section Y of FIG. 18.

FIG. 17 illustrates a plan view showing a polishing pad on which a polished substrate is projected on a polishing location. FIG. 18 illustrates a plan view showing a polished substrate. FIG. 19 illustrates an enlarged plan view showing section Y of FIG. 18.

Referring to FIGS. 18 and 19, the substrate W may have a circular shape when viewed in plan, and may or may not be a wafer. A radius of the substrate W may be called a second radius R2. The second radius R2 may range from about 140 mm to about 160 mm. For example, the second radius R2 may be 150 mm or about 150 mm. The substrate W may be divided into a plurality of regions. For example, the substrate W may be divided into first to eighth substrate regions E1 to E8. The first to eighth substrate regions E1 to E8 may have their circular or annular shapes that are homocentric with a substrate central point WCP. The plurality of regions may have therebetween boundaries that are not visible, e.g. are not actually recognized. However, the bottom surface of/active surface of the substrate W may be divided into a plurality of regions for convenience of maintenance.

The first to eighth substrate regions E1 and E8 may respectively have first to eighth substrate widths ew1 to ew8.

A width of the first substrate region E1 may indicate a width in a radius direction of the first substrate region E1.

The first substrate region E1 may have an annular shape positioned at an outermost side. A width of the first substrate region E1 may be less than that of any of other substrate regions. For example, the first substrate width ew1 may be smaller than any other one of the first to eighth substrate widths ew1 to ew8. The first substrate width ew1 may range from about 1 mm to about 10 mm. During semiconductor fabrication, defects may be most likely to occur on an edge region of a substrate W in each process. In this sense, the substrate may have the lowest yield on the edge region thereof. Therefore, it may be required to or desired to or preferred that maintenance be performed on portions of the substrate processing apparatus A that affect the edge region of the substrate. The first substrate region E1 may correspond to the edge region.

Referring to FIGS. 9 to 16, based on FIGS. 17 and 18, the first to eighth annular regions P1 to P8 may affect polishing of the first substrate region E1. Therefore, an improvement in the state of the first to eighth annular regions P1 to P8 may improve a polishing state of the first substrate region E1. In this case, when only the state of the eighth annular region P8 is adjusted, it may be possible to reduce the effect on other substrate regions.

The first to seventh annular regions P1 to P7 may affect polishing of the second substrate region E2. Therefore, an improvement in the state of the first to seventh annular regions P1 to P7 may improve a polishing state of the second substrate region E2. In this case, when only the state of the seventh annular region P7 is adjusted, it may be possible to reduce the effect on other substrate regions.

The first to sixth annular regions P1 to P6 may affect polishing of the third substrate region E3. Therefore, an improvement in the state of the first to sixth annular regions P1 to P6 may improve a polishing state of the third substrate region E3. In this case, when only the state of the first annular region P1 is adjusted, it may be possible to reduce the effect on other substrate regions.

The second to sixth annular regions P2 to P6 may affect the polishing state of the fourth substrate region E4. Therefore, an improvement in the state of the second to sixth annular regions P2 to P6 may improve a polishing state of the fourth substrate region E4. In this case, when only the state of the sixth annular region P6 is adjusted, it may be possible to reduce the effect on other substrate regions.

The second to fifth annular regions P2 to P5 may affect polishing of the fifth substrate region E5. Therefore, an improvement in the state of the second to fifth annular regions P2 to P5 may improve a polishing state of the fifth substrate region E5. In this case, when only the state of the fifth annular region P5 is adjusted, it may be possible to reduce the effect on other substrate regions.

The second to fourth annular regions P2 to P4 may affect polishing of the sixth substrate region E6. Therefore, an improvement in the state of the second to fourth annular regions P2 to P4 may improve a polishing state of the sixth substrate region E6. In this case, when only the state of the second annular region P2 is adjusted, it may be possible to reduce the effect on other substrate regions.

The third and fourth annular regions P3 and P4 may affect polishing of the seventh substrate region E7. Therefore, an improvement in the state of the third and fourth annular regions P3 and P4 may improve a polishing state of the seventh substrate region E7. In this case, when only the state of the fourth annular region P4 is adjusted, it may be possible to reduce the effect on other substrate regions.

The third annular region P3 may affect polishing of the eighth substrate region E8. Therefore, an improvement in the state of the third annular region P3 may improve a polishing state of the eighth substrate region E8.

Referring to FIGS. 4B and 18, the ascertainment step S51 may include detecting a target area, which corresponds to portions of the substrate processing apparatus A that requires or would benefit from improvement, on the bottom surface of the substrate W. For example, a portion that requires or would benefit from an improvement in polishing state or polishing rate may be found based on the bottom surface of the substrate W. The portion that requires an improvement in polishing state may mean, for example, an area where polishing is either not sufficiently performed or is excessively executed. In some example embodiments, for example as illustrate in FIG. 18, three target areas may be found. A first target area DR1 may be positioned on the sixth substrate region E6. A second target area DR2 may be positioned on the fourth substrate region E4. A third target area DR3 may be positioned on the first substrate region E1.

Referring to FIGS. 4B and 17, the selection step S52 may include selecting an annular region in contact with a target area. For example, when the bottom surface/active surface of the substrate W that rotates in the polishing location WL is in contact with the top surface 1U of the polishing pad 1, an annular region may be selected which is in contact with a target area. The annular region in contact with a target area may be called a contact annular region.

For example, with regard to the first target area DR1, the contact annular region may be the fourth annular region P4, the third annular region P3, and the second annular region P2.

With regard to the second target area DR2, the second to sixth annular regions P2 to P6 may be the contact annular region.

With regard to the third target area DR3, the first to eighth annular regions P1 to P8 may be the contact annular region.

The selection step S52 may further include selecting one of a plurality of contact annular regions that is most remote from a central point of the polishing location WL. For example, there may be a selection of one of a plurality of contact annular regions that is most remote from the second central point WLCP. The contact annular region that is most remote from the second central point WLCP may indicate a contact annular region having a large smaller distance, e.g. a largest minimum distance from the second central point WLCP. A target annular region may be defined to refer to one of the plurality of contact annular regions that is most remote from the second central point WLCP. The target annular region may indicate a contact annular region whose effect on other substrate regions is smaller than any other of the plurality of contact annular regions.

For example, as discussed above, with regard to the first target area DR1, the contact annular region may be or may include the second to fourth annular regions P2, P3, and P4. The target annular region may be or may include the second annular region P2 that is most remote from the second central point WLCP.

As discussed above, with regard to the second target area DR2, the contact annular region may be or may include the second to sixth annular regions P2 to P6. In this case, the target annular region may be the sixth annular region P6 that is most remote from the second central point WLCP.

As discussed above, with regard to the third target area DR3, the contact annular region may be the first to eighth annular regions P1 to P8. In this case, the target annular region may be the eighth annular region P8 that is most remote from the second central point WLCP.

The condition change step S61 may include changing at least one selected from modulus of elasticity, hardness, roughness, density, porosity, and groove shape of the target annular region. A change in physical properties of the target annular region may improve polishing performance, such as polishing rate and/or propensity for defects such as scratches/chatter marks of a target area. A variety of methods may be employed to change physical properties of the target annular region. For example, the conditioning disk (see 7 of FIG. 1) may be used to abrade only a top surface of the target annular region to change roughness of the target annular region. Alternatively or additionally, other methods may be utilized to change physical properties of the target annular region. Therefore, improvements in the target area may improve in polishing performance.

In some example embodiments, each of the central region PC and the boundary annular region PE may affect the bottom surface 53*b* of the retaining ring 53 (see FIG. 6). During the polishing process, the bottom surface 53*b* of the retaining ring 53 may contact each of the central region PC and the boundary annular region PE. Therefore, conditions of the central region PC and/or the boundary annular region PE may be changed by ascertaining a condition of the bottom surface 53*b* of the retaining ring 53. An adjustment in condition of the central region PC and/or the boundary annular region PE may control a polishing effect caused by the retaining ring 53. For example, a slurry flow and/or a rebound phenomenon of the retaining ring 53 may be controlled by adjusting the condition of the central region PC and/or the boundary annular region PE.

The partial replacement step S62 may include replacing the target annular region. When a plurality of annular regions are separable from each other, the separation and replacement of only the target annular region may readily change physical properties. Therefore, improvements in the target area may improve in polishing performance.

According to a substrate polishing apparatus in accordance with some example embodiments of inventive concepts, a substrate polishing method using the same, and/or a semiconductor fabrication method including the same, a substrate may be more easily controlled in the substrate's polishing state. For example, when only a portion of a plurality of substrate regions is required to/would benefit from improvement in a polishing state, it may be possible to improve the polishing state of the related substrate region while minimizing or reducing the effect on other substrate regions. Accordingly, the polishing state of the substrate may be more accurately and/or more easily controlled. Alternatively or additionally, a yield and/or a reliability may be increased and/or a reduction in defects such as scratches may occur.

According to a substrate polishing apparatus in accordance with some example embodiments of inventive concepts, a substrate polishing method using the same, and/or a semiconductor fabrication method including the same, an outer overlapping section may have a width less than that of other overlapping annular regions. Therefore, it may be possible to manage in detail a first substrate region that is an edge region positioned at an outermost side on the substrate. For example, a polishing state may be controlled for only a thin edge region. During semiconductor fabrication, a variety of process issues, such as defects, may occur on the edge region of the substrate. Because the polishing state is controlled for only the edge region, the edge region may be more precisely controlled. Accordingly, there may be a process improvement such as a reduction in failure rate on the edge region, which may result in an increase in manufacturing yield and/or reliability.

Figure 20:
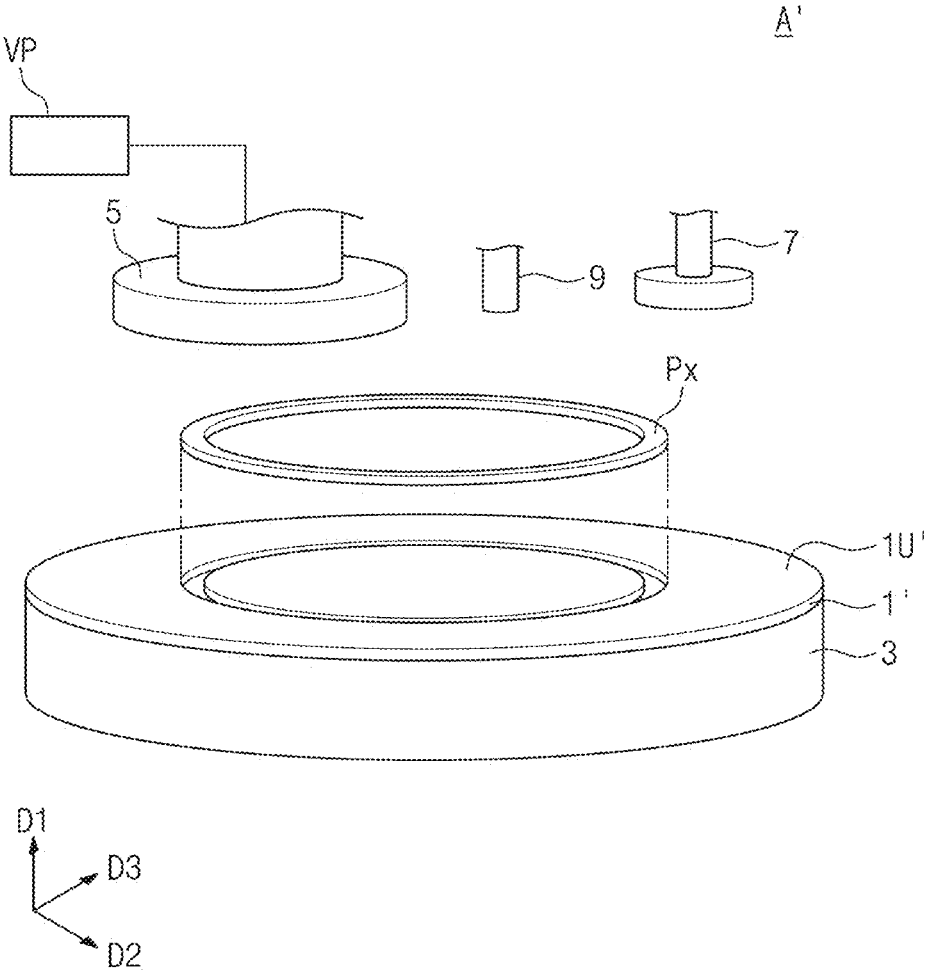
FIG. 20 illustrates a perspective view showing a substrate polishing apparatus according to some example embodiments of inventive concepts.

FIG. 20 illustrates a perspective view showing a substrate polishing apparatus according to some example embodiments of inventive concepts.

For convenience of description, the following will omit the description substantially the same as or similar to that discussed with reference to FIGS. 1 to 19.

Referring to FIG. 20, a polishing pad 1' may have a plurality of pads that are separable from each other. For example, a certain pad Px may be separated from other pads. Therefore, when only a partial region of the polishing pad 1' is required to improve/would benefit from an improvement in its state, only the partial region may be replaced and the replaced region may be used. The partial replacement method may induce promptness of work and accurate replacement of only an interest region.

Figure 21:
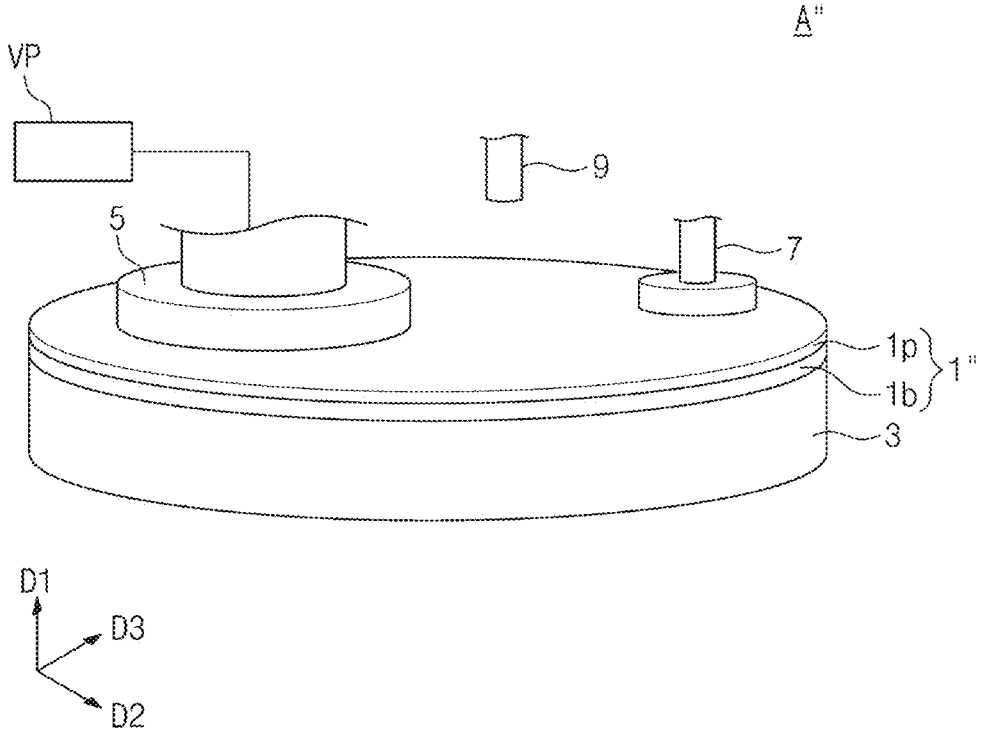
FIG. 21 illustrates a perspective view showing a substrate polishing apparatus according to some example embodiments of inventive concepts.

FIG. 21 illustrates a perspective view showing a substrate polishing apparatus according to some example embodiments of inventive concepts.

For convenience, the following will omit the description substantially the same as or similar to that discussed with reference to FIGS. 1 to 20.

Referring to FIG. 21, a polishing pad 1" may include a base plate 1*b* and a pad 1*p*. The base plate 1*b* may have a disk shape. The pad 1*p* may be positioned on the base plate 1*b*. The pad 1*p* and the base plate 1*b* may be combined with each other through an adhesive or not. As discussed with reference to FIG. 1, the pad 1*p* may be divided into a plurality of regions.

Figure 22:
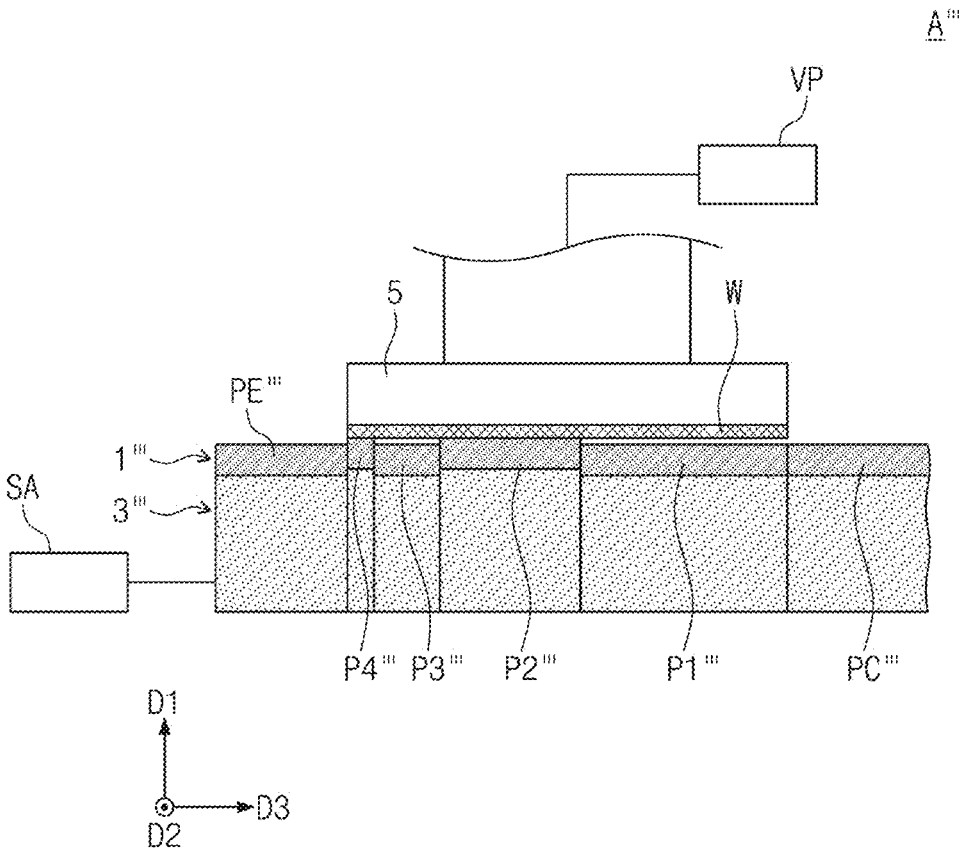
FIG. 22 illustrates a cross-sectional view showing a substrate polishing apparatus according to some example embodiments of inventive concepts.

FIG. 22 illustrates a cross-sectional view showing a substrate polishing apparatus according to some example embodiments of inventive concepts.

For convenience, the following will omit the description substantially the same as or similar to that discussed with reference to FIGS. 1 to 21.

Referring to FIG. 22, a polishing pad 1''' may have a plurality of pads PC''', P1''', P2''', P3''', P4''', and PE''' that are separable from each other. In addition, a stage 3''' may also be divided into a plurality of pieces whose number is the same as that of the pads. A stage driving device SA may drive the multi-divided stage 3''' to move upwards and downwards. For example, a partial region of the stage 3''' may ascend to press some pads P2''' and P4'''. Therefore, it may be possible to strongly press a certain portion of the substrate W that is polished while being adsorbed on the polishing head 5. A large amount of polishing may be performed on the strongly pressed portion of the substrate W. The stage driving device SA may be or may include a robot, and/or an actuator, and/or an engine that is configured to drive the multi-divided stage 3'''.

Figure 23:
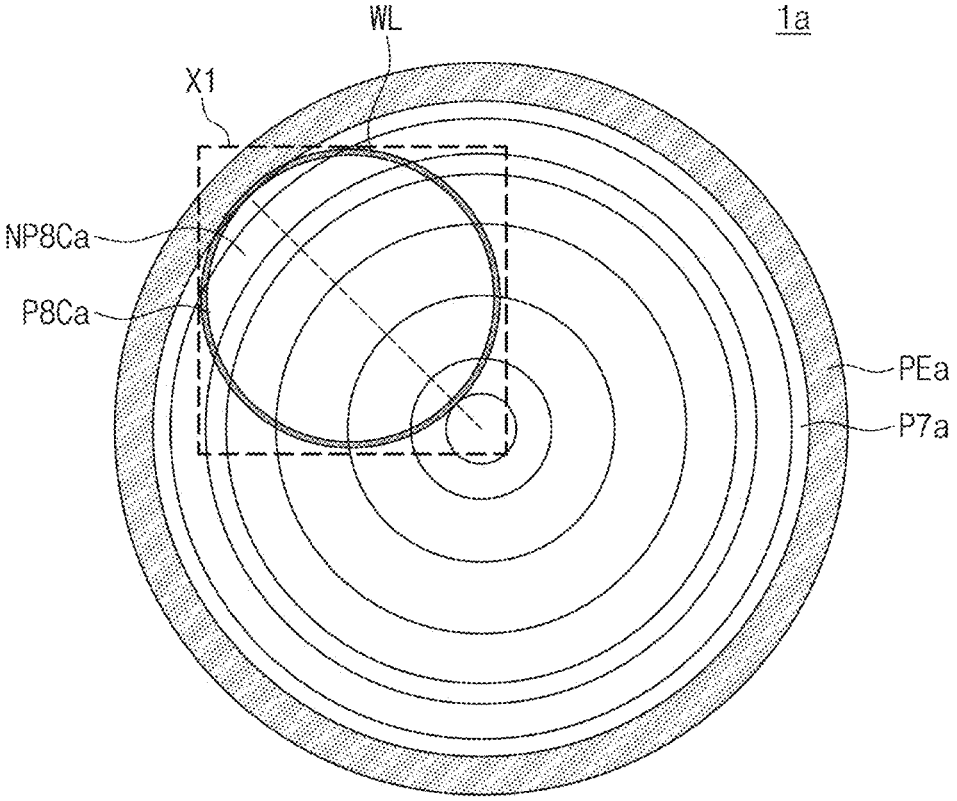
FIG. 23 illustrates a plan view showing a polishing pad of a substrate polishing apparatus according to some example embodiments of inventive concepts.
Figure 24:
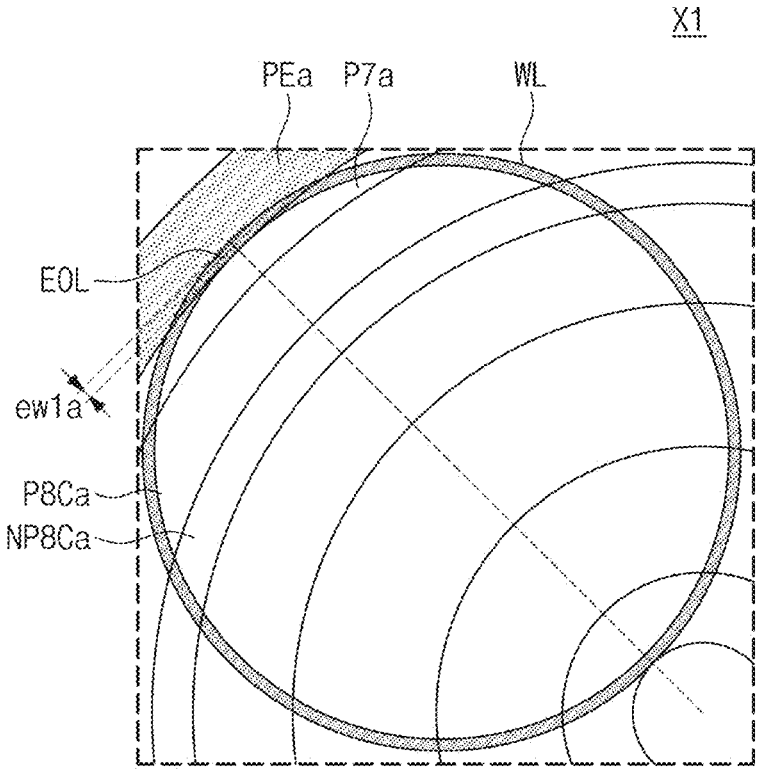
FIG. 24 illustrates an enlarged plan view showing section X1 of FIG. 23.

FIG. 23 illustrates a plan view showing a polishing pad of a substrate polishing apparatus according to some example embodiments of inventive concepts. FIG. 24 illustrates an enlarged plan view showing section X1 of FIG. 23.

For convenience of description, the following will omit the description substantially the same as or similar to that discussed with reference to FIGS. 1 to 22.

Referring to FIGS. 23 and 24, differently from that discussed with reference to FIGS. 2 and 3, a polishing pad 1*a* may have a boundary annular region PEa as an outer annular region thereof. An outer overlapping section EOL may denote an area where the boundary annular region PEa overlaps the polishing location WL. A width in a radius direction of the outer overlapping section EOL may be less than those in a radius direction of other overlapping annular regions. The width of the outer overlapping section EOL may be called an outer overlapping width ew1*a*.

Figure 25:
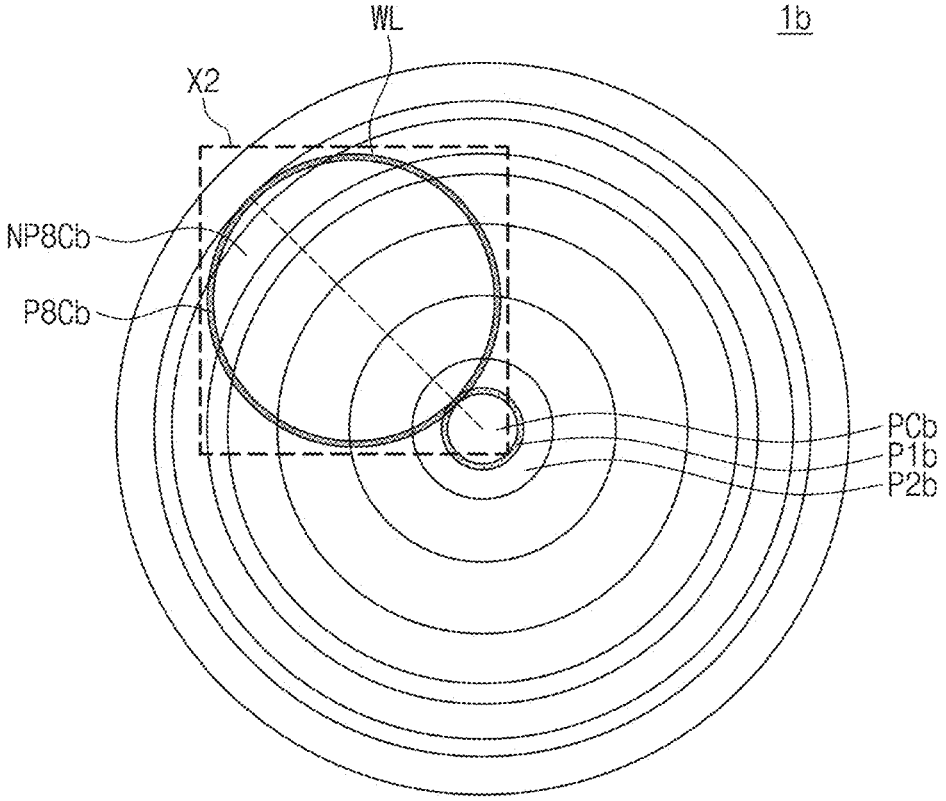
FIG. 25 illustrates a plan view showing a polishing pad of a substrate polishing apparatus according to some example embodiments of inventive concepts.
Figure 26:
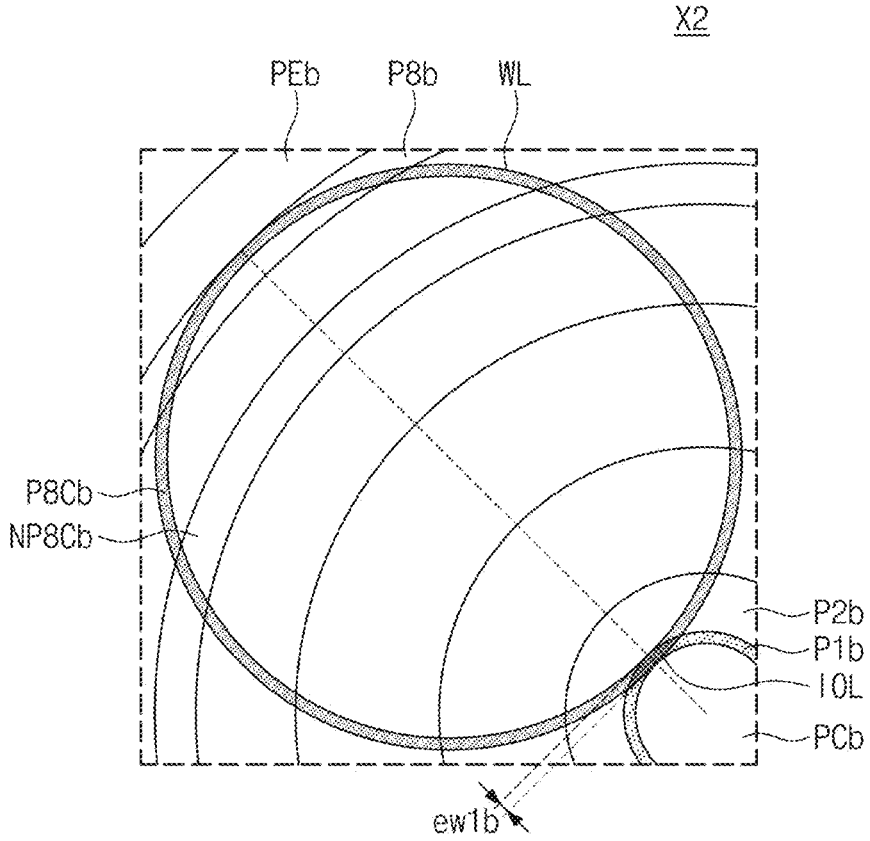
FIG. 26 illustrates an enlarged plan view showing section X2 of FIG. 25.

FIG. 25 illustrates a plan view showing a polishing pad of a substrate polishing apparatus according to some example embodiments of inventive concepts. FIG. 26 illustrates an enlarged plan view showing section X2 of FIG. 25.

For convenience of description, the following will omit the description substantially the same as or similar to that discussed with reference to FIGS. 1 to 24.

Referring to FIGS. 25 and 26, differently from that discussed with reference to FIGS. 2 and 3, an inner annular region may be defined to refer to an innermost one of the overlapping annular regions. For example, the inner annular region may be defined to indicate one of a plurality of overlapping annular regions that is most remote from the central point CP. The inner annular region may be called an inner overlapping pad. In the embodiment of FIG. 26, the inner overlapping pad may be a first annular region P1*b*.

An inner overlapping section IOL may be defined to refer to an area where the inner overlapping pad overlaps the polishing location WL. In the embodiment of FIG. 26, the inner overlapping section IOL may denote an area where the first annular region P1*b* and the polishing location WL overlap each other. A width in a radius direction of the inner overlapping section IOL may be less than those in a radius direction of other overlapping annular regions. In the embodiment of FIG. 26, the width of the inner overlapping section IOL may be the same as or similar to a first width ew1*b* of the first annular region P1*b*.

Figure 27:
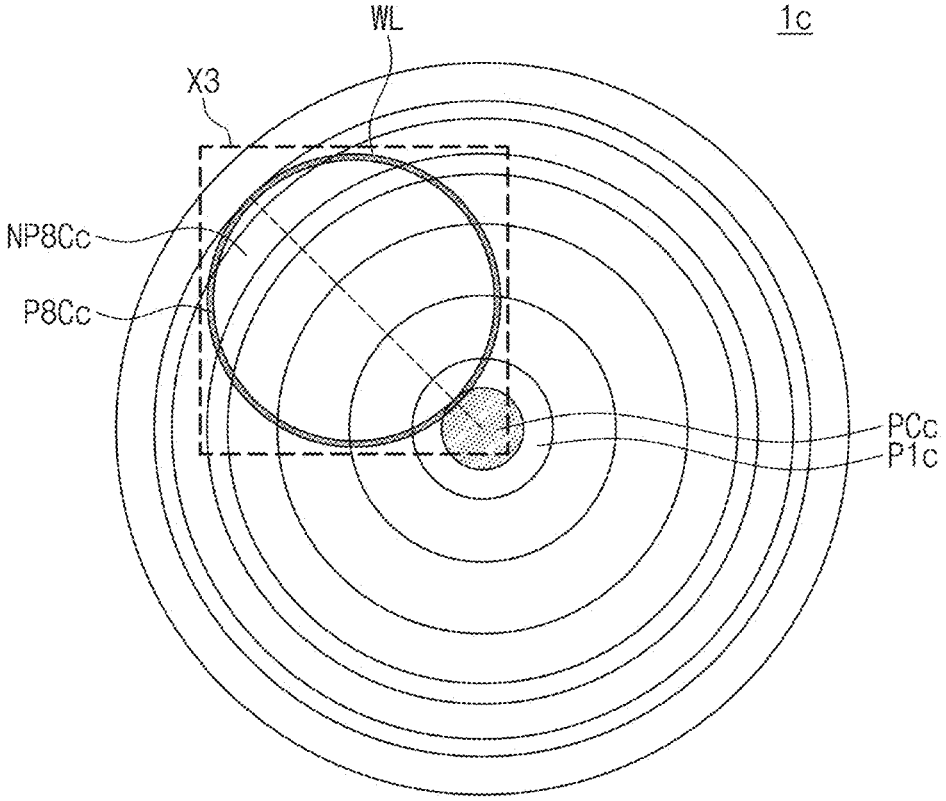
FIG. 27 illustrates a plan view showing a polishing pad of a substrate polishing apparatus according to some example embodiments of inventive concepts.
Figure 28:
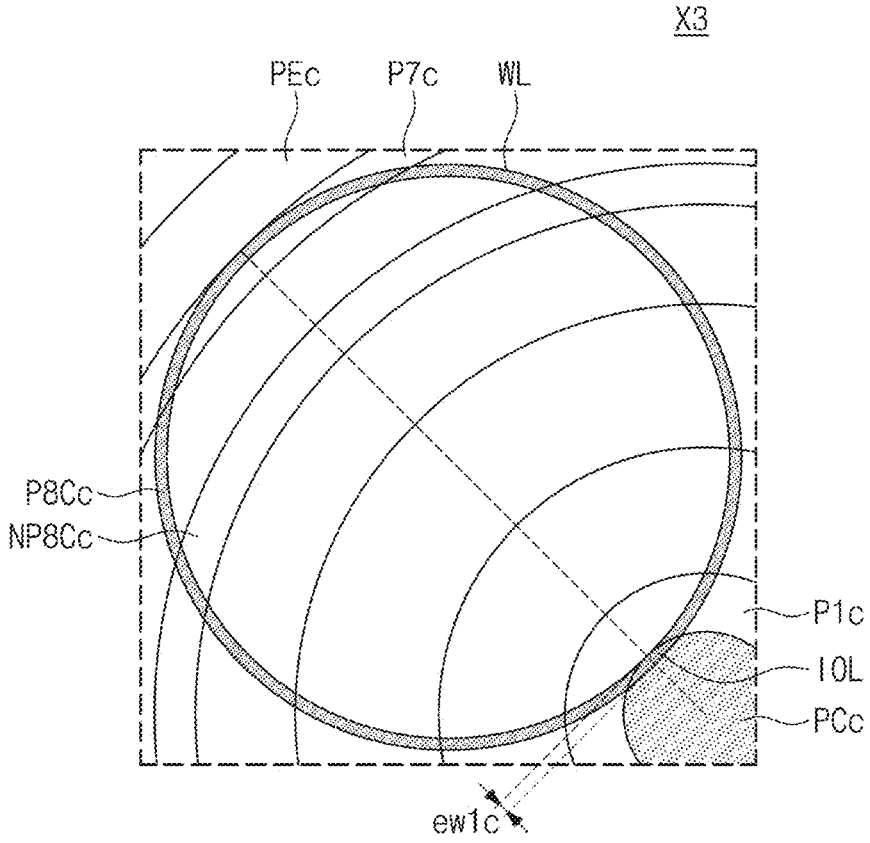
FIG. 28 illustrates an enlarged plan view showing section X3 of FIG. 27.

FIG. 27 illustrates a plan view showing a polishing pad of a substrate polishing apparatus according to some example embodiments of inventive concepts. FIG. 28 illustrates an enlarged plan view showing section X3 of FIG. 27.

For convenience, the following will omit the description substantially the same as or similar to that discussed with reference to FIGS. 1 to 26.

Referring to FIGS. 27 and 28, differently from that discussed with reference to FIGS. 25 and 26, the polishing pad 1*a* may have a central pad PCc as the inner overlapping pad. An inner overlapping section IOL may denote an area where the central pad PCc overlaps the polishing location WL. A width ew1*c* in a radius direction of the inner overlapping section IOL may be less than those in a radius direction of other overlapping annular regions.

FIGS. 3, 24, 26, and 28 depict four embodiments each showing a region for polishing an edge of a substrate. Inventive concepts, however, are not limited thereto, and other configurations may also be accomplished to provide a pad for polishing the edge of the substrate.

According to a substrate polishing apparatus in accordance with some example embodiments of inventive concepts, a substrate polishing method using the same, and a semiconductor fabrication method including the same, it may be possible to control polishing for each region.

Alternatively or additionally, according to a substrate polishing apparatus in accordance with some example embodiments of inventive concepts, a substrate polishing method using the same, it may be possible to control and/or manage a polishing pad for each region.

Alternatively or additionally, according to a substrate polishing apparatus in accordance with some example embodiments of inventive concepts, a substrate polishing method using the same, and a semiconductor fabrication method including the same, it may be possible to reduce a failure rate in an edge region of a substrate.

Alternatively or additionally, according to a substrate polishing apparatus in accordance with some example embodiments of inventive concepts, a substrate polishing method using the same, and a semiconductor fabrication method including the same, it may be possible to increase a manufacturing yield.

Effects of inventive concepts are not limited to the mentioned above, other effects which have not been mentioned above will be clearly understood to those of ordinary skill in the art from the following description.

Although inventive concepts have been described in connection with some example embodiments of inventive concepts illustrated in the accompanying drawings, it will be understood to of ordinary skill in the art that various changes and modifications may be made without departing from the technical spirit and essential feature of inventive concepts. Furthermore none of example embodiments described are necessarily mutually exclusive with one another. For example, some example embodiments may include one or more features described with reference to one or more figures, and may also include one or more other features described with reference to one or more other figures. It therefore will be understood that the embodiments described above are just illustrative but not limitative in all aspects.

What is claimed is:

1. A substrate polishing method, comprising:

placing a substrate into a substrate polishing apparatus;

rotating each of the substrate and a polishing pad of the substrate polishing apparatus;

allowing a bottom surface of the substrate to contact a top surface of the polishing pad; and determining whether the polishing pad would benefit from undergoing maintenance, wherein the polishing pad includes a plurality of annular regions that are homocentric with a central point of the top surface of the polishing pad, wherein determining whether the polishing pad would benefit from undergoing maintenance includes, ascertaining a state of the bottom surface of the substrate, and selecting one of the plurality of annular regions by using information about the state of the bottom surface of the substrate, the one of the plurality of annular regions being in a state that would benefit from undergoing maintenance, wherein the substrate polishing apparatus includes a polishing head supporting the substrate, a stage opposite the polishing head, and the stage supporting the polishing pad.

2. The substrate polishing method of claim 1, wherein ascertaining the state of the bottom surface of the substrate includes detecting a target area on the bottom surface of the substrate, the target area being in a state indicative of benefiting from an improvement in polishing state, and wherein selecting the one of the plurality of annular regions that would benefit from undergoing maintenance includes selecting a plurality of contact annular regions from the plurality of annular regions, the plurality of contact annular regions being in contact with the target area when the bottom surface of the substrate that rotates is in contact with the top surface of the polishing pad.

3. The substrate polishing method of claim 2, wherein allowing the bottom surface of the substrate to contact the top surface of the polishing pad includes allowing that, in a polishing location, the bottom surface of the substrate is polished while being in contact with the top surface of the polishing pad, and wherein selecting the one of the plurality of annular regions that would benefit from undergoing maintenance further includes selecting a target annular region from the contact annular regions, the target annular region being most remote from a central point of the polishing location.

4. The substrate polishing method of claim 3, further comprising:

maintaining the polishing pad, wherein maintaining the polishing pad includes changing a condition of the target annular region.

5. The substrate polishing method of claim 4, wherein changing the condition of the target annular region includes changing at least one selected from a modulus of elasticity, a hardness, a roughness, a density, a porosity, and a groove shape of the target annular region.

6. The substrate polishing method of claim 3, further comprising:

maintaining the polishing pad, wherein maintaining the polishing pad includes replacing the target annular region.

7. The substrate polishing method of claim 1, wherein at least two of the plurality of annular regions have different physical properties, and the physical properties include at least one selected from a modulus of elasticity, a hardness, a roughness, a density, a porosity, and a groove shape.

8. The substrate polishing method of claim 1, wherein the plurality of annular regions are configured to be separable from each other.

9. The substrate polishing method of claim 8, further comprising:

replacing a partial area of the polishing pad based the selecting one of the plurality of annular regions being in a state that would benefit from undergoing maintenance.

10. The substrate polishing method of claim 1, wherein a diameter of the polishing pad is larger than a diameter of the substrate.

11. A semiconductor fabrication method, comprising:

preparing a substrate;

placing the substrate into a substrate polishing apparatus;

rotating each of the substrate and a polishing pad of the substrate polishing apparatus; and allowing a bottom surface of the substrate to contact a top surface of the polishing pad, wherein the allowing the bottom surface of the substrate to contact the top surface of the polishing pad includes allowing that, in a polishing location, the bottom surface of the substrate is polished while being in contact with the top surface of the polishing pad, wherein the polishing pad includes, a disk-shaped central region that includes a central point of the top surface of the polishing pad, and a plurality of annular regions that surround the central region and are homocentric with the central point, wherein, among the plurality of annular regions that overlap a portion of the polishing location when viewed in plan, a width in a radius direction of an outer overlapping section where an outer annular region overlaps the polishing location is less than a width in a radius direction of each of other annular regions that overlap the polishing location, the outer annular region being an outermost one of the plurality of annular regions that overlap a portion of the polishing location, wherein the substrate polis apparatus includes polishing head supporting the substrate, a stage opposite the polishing head, and the stage supporting the polishing pad.

12. The semiconductor fabrication method of claim 11, wherein the width in the radius direction of the outer overlapping section is in a range of about 1 mm to about 10 mm.

13. The semiconductor fabrication method of claim 11, wherein a number of the annular regions is eight.

14. The semiconductor fabrication method of claim 11, wherein, when viewed in plan, the polishing location does not overlap the central point.

15. The semiconductor fabrication method of claim 11, wherein at least two of the annular regions have different physical properties, and the physical properties include at least one selected from a modulus of elasticity, a hardness, a roughness, a density, a porosity, and a groove shape.

16. The semiconductor fabrication method of claim 11, further comprising:

determining whether the polishing pad would benefit from undergoing maintenance, wherein determining whether the polishing pad would benefit from undergoing maintenance includes, ascertaining a state of the bottom surface of the substrate, and selecting one of the annular regions by using information about the state of the bottom surface of the substrate, the one of the annular regions benefiting from undergoing maintenance.

17. The semiconductor fabrication method of claim 16, wherein ascertaining the state of the bottom surface of the substrate includes detecting a target area on the bottom surface of the substrate, the target area benefiting from undergoing an improvement in polishing state, and wherein selecting the one of the plurality of annular regions that would benefit from undergoing maintenance includes selecting a plurality of contact annular regions from the plurality of annular regions, the plurality of contact annular regions being in contact with the target area when the bottom surface of the substrate that rotates is in contact with the top surface of the polishing pad.

18. The semiconductor fabrication method of claim 17, wherein selecting the one of the plurality of annular regions that would benefit from undergoing maintenance further includes selecting a target annular region from the contact annular regions, the target annular region being most remote from a central point of the polishing location.

* * * * *